US009229379B2

(12) United States Patent
Tamaki et al.

(10) Patent No.: US 9,229,379 B2
(45) Date of Patent: Jan. 5, 2016

(54) FIXING DEVICE AND IMAGE FORMING APPARATUS

(71) Applicants: Shuntaroh Tamaki, Kanagawa (JP); Takayuki Seki, Kanagawa (JP); Yuji Arai, Kanagawa (JP); Yoshiki Yamaguchi, Kanagawa (JP); Yutaka Ikebuchi, Kanagawa (JP); Kazuya Saito, Kanagawa (JP); Naoki Iwaya, Tokyo (JP); Toshihiko Shimokawa, Kanagawa (JP)

(72) Inventors: Shuntaroh Tamaki, Kanagawa (JP); Takayuki Seki, Kanagawa (JP); Yuji Arai, Kanagawa (JP); Yoshiki Yamaguchi, Kanagawa (JP); Yutaka Ikebuchi, Kanagawa (JP); Kazuya Saito, Kanagawa (JP); Naoki Iwaya, Tokyo (JP); Toshihiko Shimokawa, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/015,035

(22) Filed: Aug. 30, 2013

(65) Prior Publication Data

US 2014/0072355 A1 Mar. 13, 2014

(30) Foreign Application Priority Data

Sep. 11, 2012 (JP) ..... 2012-199365
Sep. 14, 2012 (JP) ..... 2012-202620
Sep. 14, 2012 (JP) ..... 2012-203281

(51) Int. Cl.
*G03G 15/20* (2006.01)

(52) U.S. Cl.
CPC ..... *G03G 15/2017* (2013.01)

(58) Field of Classification Search
CPC ..... G03G 15/2017
USPC ..... 399/329, 334, 336
See application file for complete search history.

(56) References Cited

U.S. PATENT DOCUMENTS

| | | | | |
|---|---|---|---|---|
| 7,657,217 | B2 * | 2/2010 | Wakahara et al. | 399/330 |
| 2006/0029411 | A1 | 2/2006 | Ishii et al. | |
| 2006/0089314 | A1 | 4/2006 | Wakahara et al. | |
| 2007/0292175 | A1 | 12/2007 | Shinshi | |

(Continued)

FOREIGN PATENT DOCUMENTS

| | | | |
|---|---|---|---|
| CN | 101727053 | A | 6/2010 |
| CN | 102193438 | A | 9/2011 |

(Continued)

OTHER PUBLICATIONS

Machine translation of reference Yoshimura et al. (JP 2006-146,184), Pub. date Jun. 8, 2006.*

(Continued)

*Primary Examiner* — Rodney Bonnette
(74) *Attorney, Agent, or Firm* — Oblon, McClelland, Maier & Neustadt, L.L.P.

(57) ABSTRACT

A fixing device includes a rotatable fixing member; a heating source configured to heat the fixing member; an opposing member configured to come into contact with an outer circumferential surface of the fixing member to form a nip portion; and a shielding member configured to block heat from the heating source. The shielding member is configured to rotate about a position different from the center of the heating source so as to be movable between a shielding position and a retraction position. The shielding position is a position where the shielding member comes close to the heating source to block heat from the heating source to the fixing member. The retraction position being a position where the shielding member is retracted away from the shielding position.

31 Claims, 12 Drawing Sheets

(56) References Cited

U.S. PATENT DOCUMENTS

| | | | | |
|---|---|---|---|---|
| 2010/0067929 | A1 | 3/2010 | Seki | |
| 2010/0080631 | A1* | 4/2010 | Ogiyama et al. | 399/308 |
| 2011/0176822 | A1 | 7/2011 | Ishii et al. | |
| 2013/0183072 | A1 | 7/2013 | Hase et al. | |
| 2013/0209147 | A1 | 8/2013 | Ogawa et al. | |
| 2014/0016971 | A1* | 1/2014 | Arai et al. | 399/329 |
| 2014/0016972 | A1* | 1/2014 | Seshita et al. | 399/329 |
| 2014/0079424 | A1* | 3/2014 | Ikebuchi et al. | 399/69 |
| 2014/0079453 | A1* | 3/2014 | Arai et al. | 399/329 |
| 2014/0079455 | A1* | 3/2014 | Seki et al. | 399/329 |
| 2014/0133879 | A1* | 5/2014 | Seshita et al. | 399/70 |
| 2014/0248072 | A1* | 9/2014 | Yoshinaga et al. | 399/329 |
| 2014/0270820 | A1* | 9/2014 | Saito et al. | 399/33 |
| 2014/0270831 | A1* | 9/2014 | Yoshinaga et al. | 399/67 |
| 2014/0270832 | A1* | 9/2014 | Saito et al. | 399/67 |
| 2014/0270833 | A1* | 9/2014 | Yuasa et al. | 399/67 |
| 2014/0270872 | A1* | 9/2014 | Tamaki et al. | 399/329 |

FOREIGN PATENT DOCUMENTS

| | | |
|---|---|---|
| CN | 102540830 A | 7/2012 |
| JP | 2005-056595 | 3/2005 |
| JP | 2006-030885 | 2/2006 |
| JP | 2006-071960 | 3/2006 |
| JP | 2007-334205 | 12/2007 |
| JP | 2008-058833 | 3/2008 |
| JP | 4130898 | 5/2008 |
| JP | 2008-139779 | 6/2008 |
| JP | 2010-032973 | 2/2010 |
| JP | 2010-066583 | 3/2010 |

OTHER PUBLICATIONS

Chinese Office Action dated Jul. 3, 2015 for Application No. 20130570982.3, and English translation thereof.

* cited by examiner

FIXING DEVICE AND IMAGE FORMING APPARATUS

CROSS-REFERENCE TO RELATED APPLICATION

The present application claims priority to and incorporates by reference the entire contents of Japanese Patent Application No. 2012-199365 filed in Japan on Sep. 11, 2012, Japanese Patent Application No. 2012-202620 filed in Japan on Sep. 14, 2012 and Japanese Patent Application No. 2012-203281 filed in Japan on Sep. 14, 2012.

BACKGROUND OF THE INVENTION

1. Field of the Invention

The present invention relates to a fixing device that fixes an image on a recording medium, and an image forming apparatus including the fixing device.

2. Description of the Related Art

Heretofore, in an image forming apparatus such as a copying machine, a printer, a facsimile, and an MFP device of these devices, a fixing device is provided to fix a toner image held on a recording medium such as a paper sheet. Generally, the fixing device includes a fixing member heated by a heating source such as a heater and an opposing member that contacts the fixing member to form a nip portion. When an image forming operation is started in an image forming apparatus and a toner image is transferred to a paper sheet, the paper sheet passes through a nip portion between the fixing member heated at a predetermined temperature and the opposing member, and a toner held on the paper sheet is molten to fix an image.

Moreover, in the fixing device, since the paper sheet passing through the nip portion absorbs the heat of the fixing member, the fixing member is controlled to be kept an appropriate temperature using a temperature sensor or the like. In a non-paper feeding region of the fixing member where the fixing member is not in contact with the paper sheet in the width direction thereof during passage of the paper sheet through the nip portion, the heat of the fixing member does not tend to be absorbed. Thus, particularly, in a case where the paper sheets are continuously fed, a problem arises in that the temperature of the fixing member is excessively increased in the non-paper feeding region.

Therefore, heretofore, in order to solve the problem, a fixing device has been proposed in which a shielding member is provided to block heat from a heating source in the non-paper feeding region of a fixing member (see Japanese Patent No. 4130898, Japanese Patent Application Laid-open No. 2008-058833, and Japanese Patent Application Laid-open No. 2008-139779).

However, in the configuration in which the shielding member blocks heat from the heating source, since the shielding member itself is heated by the heating source, it can also be considered that the shielding member is deformed by heat depending on the use situations, for example. In the worst-case scenario, in a case where the shielding member is deformed, it is likely that the function of the shielding member is degraded or a deformed portion interferes with the other members. Thus, some configurations are necessary to suppress these events.

Furthermore, in the fixing devices, the shielding member is configured to be movable. The shielding member is disposed at an appropriate position according to the paper sheet size, so that heat can be blocked in a necessary range, and a heating region corresponding to the paper sheet width can be secured.

The fixing device described in Japanese Patent Application Laid-open No. 2006-71960 uses an induction heating method in which the fixing member is heated by generating a magnetic flux. Here, a magnetic flux shielding member that blocks a magnetic flux is made movable according to the paper sheet size, so that the heating region corresponding to the paper sheet width can be secured.

As described above, in the configuration in which the shielding member is movable, it can also be considered that the shielding member is temporarily returned at an initial position after finishing a printing operation (a fixing process) in order to control the position of the shielding member. However, in a case where the image forming apparatus is stopped in the midway point of the operation due to an abnormality, or in a case where the fixing device is detached or attached, since it is likely that the shielding member is not returned at the initial position, it is necessary to perform the operation of returning the shielding member at the initial position in performing the starting up operation of the image forming apparatus, for example. However, when it takes time to return the shielding member at the initial position in the operation, such a problem arises in that a user or the like has to wait for a long time because the printing operation (the fixing process) is not performed during returning the shielding member at the initial position.

Moreover, no specific structure is disclosed in any of Japanese Patent No. 4130898, Japanese Patent Application Laid-open No. 2008-058833, and Japanese Patent Application Laid-open No. 2008-139779 in which the shielding member is rotatably supported. Depending on the configuration of a support structure for the shielding member, the structures around the shielding member are complicated or increased in size, and it is likely to degrade the flexibility of the layout in the design of the fixing device as well as the image forming apparatus.

Therefore, there is a need for a fixing device that is capable of suppressing the heating of a shielding member, and an image forming apparatus including the fixing device.

Moreover, there is a need for a fixing device that is capable of shortening time to return a shielding member at an initial position, and an image forming apparatus including the fixing device.

Furthermore, there is a need for a fixing device that is capable of rotatably supporting a shielding member using a compact, simple mechanism, and an image forming apparatus including the fixing device.

SUMMARY OF THE INVENTION

According to an embodiment, there is provided a fixing device that includes a rotatable fixing member; a heating source configured to heat the fixing member; an opposing member configured to come into contact with an outer circumferential surface of the fixing member to form a nip portion; and a shielding member configured to block heat from the heating source. The shielding member is configured to rotate about a position different from the center of the heating source so as to be movable between a shielding position and a retraction position. The shielding position is a position where the shielding member comes close to the heating source to block heat from the heating source to the fixing member. The retraction position being a position where the shielding member is retracted away from the shielding position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
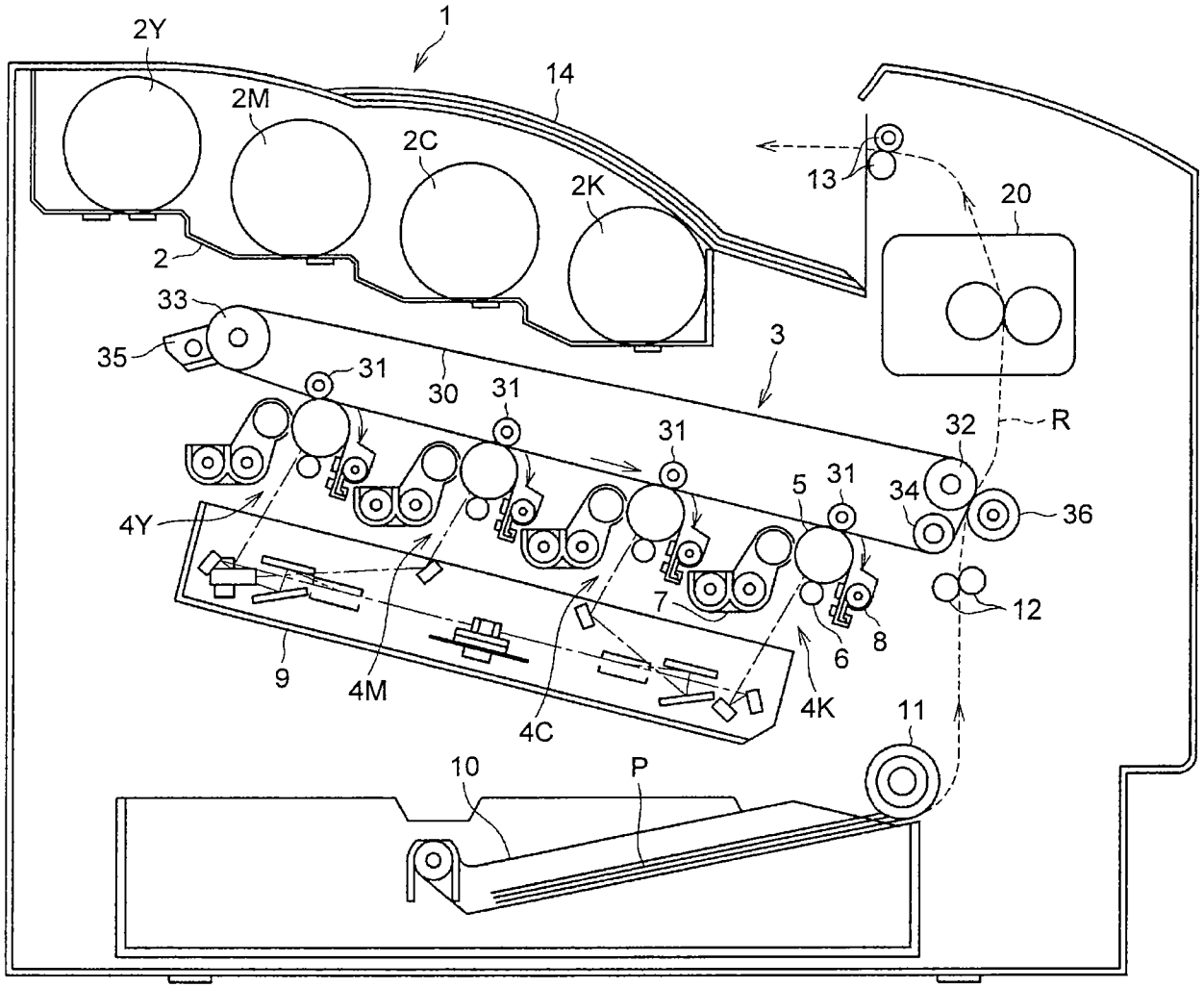
FIG. 1 is an explanatory view of the schematic configuration of an image forming apparatus according to an embodiment.

In the following, embodiments of the present invention will be described with reference to the drawings. It is noted that in the drawings for describing the embodiments, components such as members and elements having the same functions or the same shapes are designated the same reference numerals and signs and the descriptions are omitted after once described as long as the components can be distinguished from each other.

First Embodiment

First, the overall structure and operation of an image forming apparatus according to an embodiment of the present invention will be described with reference to FIG. 1.

An image forming apparatus 1 illustrated in FIG. 1 is a color laser printer, in which four image forming units 4Y, 4M, 4C, and 4K are provided in the center of an apparatus main body. The image forming units 4Y, 4M, 4C, and 4K are similarly configured except that the image forming units 4Y, 4M, 4C, and 4K include different yellow (Y), magenta (M), cyan (C), and black (K) developers corresponding to color separation components of a color image.

More specifically, the image forming units 4Y, 4M, 4C, and 4K include a drum photosensitive element 5 as a latent image holder, a charging device 6 that electrically charges the surface of the photosensitive element 5, a developing unit 7 that supplies a toner to the surface of the photosensitive element 5, a cleaning device 8 that cleans the surface of the photosensitive element 5, and so on. It is noted that in FIG. 1, reference numerals and signs are marked only to the photosensitive element 5, the charging device 6, the developing unit 7, and the cleaning device 8 included in the black image forming unit 4K, and the reference numerals and signs are omitted in the other image forming units 4Y, 4M, and 4C.

An exposure system 9 is disposed below each image forming units 4Y, 4M, 4C, and 4K to expose the surface of the photosensitive element 5. The exposure system 9 includes a light source, a polygon mirror, an f-O lens, a reflecting mirror, and so on, and applies a laser beam to the surfaces of the photosensitive elements 5 based on image data.

Moreover, a transfer device 3 is disposed above each image forming units 4Y, 4M, 4C, and 4K. The transfer device 3 includes an intermediate transfer belt 30 as an intermediate transfer body, four primary transfer rollers 31 as primary transfer units, a secondary transfer roller 36 as a secondary transfer unit, a secondary transfer backup roller 32, a cleaning backup roller 33, a tension roller 34, and a belt cleaning device 35.

The intermediate transfer belt 30 is an endless belt, and stretched using the secondary transfer backup roller 32, the cleaning backup roller 33, and the tension roller 34. Here, the secondary transfer backup roller 32 is rotated to cause the intermediate transfer belt 30 to go around (rotate) in the direction indicated by an arrow in FIG. 1.

The four primary transfer rollers 31 individually form a primary transfer nip as sandwiching the intermediate transfer belt 30 between the photosensitive elements 5 and the primary transfer rollers 31. Moreover, a power supply, not illustrated, is connected to the primary transfer rollers 31, and a predetermined direct current voltage (DC) or a predetermined ac voltage (AC) are applied to the primary transfer rollers 31.

The secondary transfer roller 36 forms a secondary transfer nip as sandwiching the intermediate transfer belt 30 between the secondary transfer backup roller 32 and the secondary transfer roller 36. Furthermore, as similar to the primary transfer rollers 31, the power supply, not illustrated, is also connected to the secondary transfer roller 36, and a predetermined direct current voltage (DC) or a predetermined ac voltage (AC) are applied to the secondary transfer roller 36.

The belt cleaning device 35 includes a cleaning brush and a cleaning blade disposed so as to contact the intermediate transfer belt 30. A waste toner transfer hose, not illustrated, extending from the belt cleaning device 35 is connected to an inlet of a waste toner container, not illustrated.

A bottle accommodating portion 2 is provided above a printer main body. Four toner bottles 2Y, 2M, 2C, and 2K that accommodate supplemental toners are removably mounted on the bottle accommodating portion 2. Supply lines, not illustrated, are provided between the toner bottles 2Y, 2M, 2C, and 2K and the developing units 7. Toners are replenished from the toner bottles 2Y, 2M, 2C, and 2K to the developing units 7 through the supply lines.

On the other hand, below the printer main body, a paper feed tray 10 that accommodates paper sheets P as recording media, a paper feeding roller 11 that feeds the paper sheets P from the paper feed tray 10, and so on are provided. It is noted that the recording media include thick paper, a postcard, an envelope, thin paper, enamel paper (such as coated paper and art paper), tracing paper, an OHP sheet, and so on, other than plain paper. Moreover, although not illustrated in the drawing, a manual feeding mechanism may be provided.

In the printer main body, a transport path R is disposed to feed the paper sheet P from the paper feed tray 10 to the secondary transfer nip for ejection. In the transport path R, a pair of registration rollers 12 is disposed on the upstream side of the position of the secondary transfer roller 36 in the paper sheet transfer direction. The registration rollers 12 are timing rollers to carry the paper sheet P to the secondary transfer nip as measuring transport timing.

Furthermore, a fixing device 20 is disposed on the downstream side of the position of the secondary transfer roller 36 in the paper sheet transfer direction to fix an unfixed image transferred on the paper sheet P. In addition, a pair of discharging rollers 13 is provided on the downstream side of the fixing device 20 in the transport path R in the paper sheet transfer direction to eject the paper sheet out of the apparatus. Moreover, a discharge tray 14 is provided on the top face of the printer main body to store the paper sheet ejected out of the apparatus.

Next, the basic operation of the printer according to the embodiment will be described with reference to FIG. 1.

When the image forming operation is started, the photosensitive elements 5 of the image forming units 4Y, 4M, 4C, and 4K are rotated clockwise in FIG. 1 using a drive unit, not illustrated, and the surfaces of the photosensitive elements 5 are uniformly electrically charged at a predetermined polarity using the charging device 6. A laser beam is individually applied to the electrically charged surfaces of the photosensitive elements 5 from the exposure system 9, and an electrostatic latent image is formed on the surfaces of the photosensitive elements 5. In the forming, information about an image exposed on the photosensitive elements 5 is information about monochrome images that a desired full-color image is separated into color information of yellow, magenta, cyan, and black. Toners are supplied to the electrostatic latent images thus formed on the photosensitive elements 5 using the developing units 7, so that the electrostatic latent images appear (are visualized) as toner images.

Moreover, when the image forming operation is started, the secondary transfer backup roller 32 is rotated counterclockwise in FIG. 1, and the intermediate transfer belt 30 is caused to go around in the direction indicated by the arrow in FIG. 1. Furthermore, a voltage controlled at a constant voltage or a constant current having the reverse polarity of the charged polarity of the toner is applied to the primary transfer rollers 31, and a transfer field is formed at the primary transfer nip between the primary transfer rollers 31 and the photosensitive elements 5.

After that, when the color toner images on the photosensitive elements 5 reach the primary transfer nip in association with the rotation of the photosensitive elements 5, the toner images on the photosensitive elements 5 are in turn laid on and transferred to the intermediate transfer belt 30 with the transfer field formed at the primary transfer nip. Therefore, a full color toner image is held on the surface of the intermediate transfer belt 30. Moreover, the toners on the photosensitive elements 5, which are not transferred to the intermediate transfer belt 30, are removed by the cleaning device 8. The electricity on the surfaces of the photosensitive elements 5 is then eliminated by a neutralization device, not illustrated, and the surface potential is initialized.

Below the printer, the paper feeding roller 11 starts rotation, and the paper sheet P is delivered from the paper feed tray 10 to the transport path R. The transportation of the paper sheet P delivered to the transport path R is temporarily stopped by the registration roller 12.

After that, the rotation of the registration roller 12 is started at a predetermined timing, and the paper sheet P is carried to the secondary transfer nip as matched with the timing at which the toner images on the intermediate transfer belt 30 reach the secondary transfer nip. At this time, a transfer voltage having the reverse polarity of the charged polarity of the toners of the toner images on the intermediate transfer belt 30 is applied to the secondary transfer roller 36, and thus a transfer field is formed on the secondary transfer nip. The toner images on the intermediate transfer belt 30 are then collectively transferred to the paper sheet P with the transfer field. Moreover, the remaining toners on the intermediate transfer belt 30, which are not transferred to the paper sheet P at this time, are removed by the belt cleaning device 35, and the removed toners are carried to and recovered in the waste toner container, not illustrated.

After that, the paper sheet P is carried to the fixing device 20, and the toner image on the paper sheet P is fixed to the paper sheet P using the fixing device 20. The paper sheet P is then ejected out of the apparatus by the discharging roller 13, and stored on the discharge tray 14.

The description above is the image forming operation when a full-color image is formed on a paper sheet. However, such a configuration may be possible in which any one of the four image forming units 4Y, 4M, 4C, and 4K is used to form a monochrome image, or two or three image forming units are used to form a two-color image or a three-color image.

Figure 2:
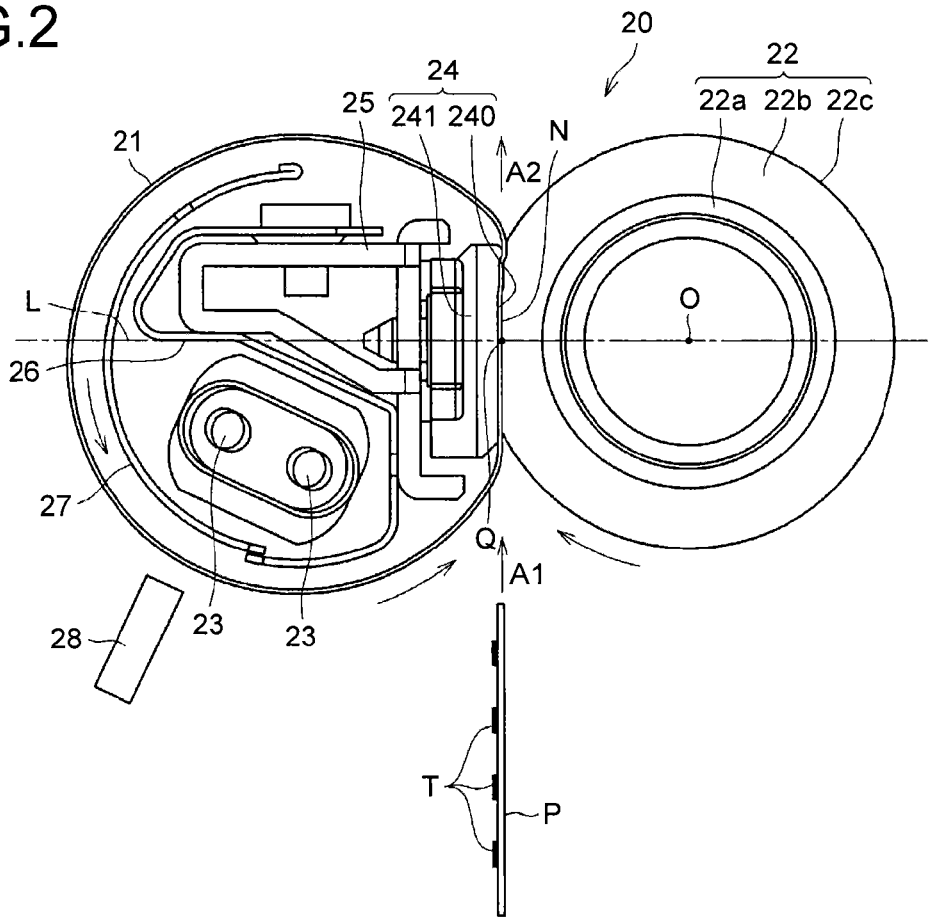
FIG. 2 is a cross sectional view of a fixing device mounted on the image forming apparatus.

FIG. 2 is a cross sectional view of the fixing device according to the embodiment.

In the following, the configuration of the fixing device 20 will be described with reference to FIG. 2.

As illustrated in FIG. 2, the fixing device 20 includes a fixing belt 21 as a fixing member, a pressing roller 22 as an opposing member that comes into contact with the outer circumferential surface of the fixing belt 21, halogen heaters 23 as a heating source that heat the fixing belt 21, a nip forming member 24 that comes into contact with the pressing roller 22 from the inner circumferential side of the fixing belt 21 to form a nip portion N, a stay 25 as a support member that supports the nip forming member 24, a reflecting member 26 that reflects heat from the halogen heaters 23 to the fixing belt 21, a shielding member 27 that blocks heat from the halogen heaters 23, and a temperature sensor 28 as a temperature detecting unit that detects the temperature of the fixing belt 21.

The fixing belt 21 is configured of a thin, flexible endless belt member (including a film). In detail, the fixing belt 21 is configured of a base material on the inner circumferential side formed of a metal material such as nickel and SUS or a resin material such as polyimide (PI) and of a mold releasing layer on the outer circumferential side formed of a tetrafluoroethylene-perfluoroalkyl vinyl ether copolymer (PFA), polytetrafluoro-ethylene (PTFE), or the like. Moreover, an elastic layer formed of a rubber material such as silicone rubber, foamed silicone rubber, and fluorine rubber may be provided between the base material and the mold releasing layer.

In a case where the elastic layer is not provided, it is likely that although fixability of toner is improved because heat capacity is reduced, micro irregularities on the belt surface are transferred to an image, and gloss irregularities are caused on solid portions of the image when unfixed toner is pressed and fixed. In order to prevent the gloss irregularities, desirably, an elastic layer having a thickness of 100 μm or more is provided. The elastic layer having a thickness of 100 μm or more is provided to absorb micro irregularities by the elastic deformation of the elastic layer, so that the occurrence of gloss irregularities can be avoided.

In the embodiment, in order to reduce the heat capacity of the fixing belt 21, the thickness and diameter of the fixing belt 21 are reduced. More specifically, the thicknesses of the base material, the elastic layer, and the mold releasing layer configuring the fixing belt 21 are set in the ranges of 20 to 50 μm, 100 to 300 μm, and 10 to 50 μm, respectively, and the overall thickness is set to 1 mm or less. Moreover, the diameter of the fixing belt 21 is set to 20 to 40 mm. In order to further reduce the heat capacity, desirably, the overall thickness of the fixing belt 21 is set to 0.2 mm or less, and more desirably, a thickness of 0.16 mm or less. In addition, desirably, the diameter of the fixing belt 21 is 30 mm or less.

The pressing roller 22 is configured of a cored bar 22*a*, an elastic layer 22*b* formed of foamed silicone rubber, silicone rubber, fluorine rubber, or the like provided on the surface of the cored bar 22*a*, and a mold releasing layer 22*c* formed of PFA, PTFE, or the like provided on the surface of the elastic layer 22*b*. The pressing roller 22 is pressurized to the fixing belt 21 side by a pressurizing unit (not illustrated), and comes into contact with the nip forming member 24 through the fixing belt 21. At a place where the pressing roller 22 and the fixing belt 21 are pressed against each other, the elastic layer 22*b* of the pressing roller 22 becomes flat to form the nip portion N in a predetermined width. It is noted that the fixing member and the opposing member are not limited to the case where the fixing member and the opposing member are pressed against each other. Such a configuration may be possible in which the fixing member simply comes into contact with the opposing member without applying a pressure.

Moreover, the pressing roller 22 is configured to be rotated using a driving source such as a motor (not illustrated) provided on the printer main body. When the pressing roller 22 is rotated, the driving force is transmitted to the fixing belt 21 at the nip portion N, and the fixing belt 21 follows the rotation.

In the embodiment, the pressing roller 22 is a solid roller. However, the pressing roller 22 may be a hollow roller. In this case, a heating source such as a halogen heater may be arranged in the hollow portion of the pressing roller 22. Moreover, the elastic layer 22*b* may be solid rubber. However, in a case where no heating source is provided in the pressing roller 22, sponge rubber may be used. It is more desirable to use sponge rubber because the heat-insulating properties are improved and the heat of the fixing belt 21 does not tend to be removed therefrom.

The halogen heaters 23 are disposed on the inner circumferential side of the fixing belt 21 and on the upstream side of the nip portion N in the paper sheet transfer direction. In detail, in FIG. 2, suppose that a virtual straight line passing through both of a center Q of the nip portion N in the paper sheet transfer direction and a rotation center O of the pressing roller 22 is L, the halogen heaters 23 are disposed on the upstream side of the virtual straight line L in the paper sheet transfer direction (on the lower side in FIG. 2). The halogen heaters 23 are configured such that the output of the halogen heaters 23 is controlled by a power supply unit provided on the printer main body to generate heat, and the output is controlled based on the result of detecting the surface temperature of the fixing belt 21 by the temperature sensor 28. The output of the heaters 23 is controlled in this manner, so that the temperature of the fixing belt 21 (a fixing temperature) can be set at a desired temperature. Alternatively, such a configuration may be possible in which instead of the temperature sensor to detect the temperature of the fixing belt 21, a temperature sensor (not illustrated in FIG. 2) is provided to detect the temperature of the pressing roller 22, and the temperature of the fixing belt 21 is predicted from the temperature detected at the temperature sensor.

In the embodiment, two halogen heaters 23 are provided. However, the number of the halogen heaters 23 used may be one or three or more according to the size of a paper sheet used in the printer, for example. Moreover, for the heating source to heat the fixing belt 21, a resistance heater, a carbon heater, or the like may be used other than the halogen heater.

The nip forming member 24 includes a base pad 241 and a slide sheet 240 of low frictional properties provided on a face of the base pad 241 opposite to the fixing belt 21. The base pad 241 is longitudinally disposed across the axial direction of the fixing belt 21 or across the axial direction of the pressing roller 22. The pressing roller 22 pressurizes the base pad 241, whereby the shape of the nip portion N is determined. In the embodiment, the shape of the nip portion N is flat. However, the shape of the nip portion N may be in a recessed shape or in other shapes. The slide sheet 240 is provided to reduce sliding friction in rotating the fixing belt 21. It is noted that in a case where the base pad 241 itself is formed of a low frictional member, the slide sheet 240 may not be provided.

The base pad 241 is configured of a heat-resisting member having a heatproof temperature of 200° C. or more. The base pad 241 prevents the deformation of the nip forming member 24 caused by heat in a toner fixing temperature range, secures the nip portion N in a stable state, and stabilizes output image quality. For the material of the base pad 241, a typical heat-resisting resin can be used such as polyether sulfone (PES), polyphenylene sulfide (PPS), a liquid crystal polymer (LCP), polyether nitrile (PEN), polyamide-imide (PAI), and polyether ether ketone (PEEK).

The base pad 241 is fixed and supported by the stay 25. Thus, it is prevented that the nip forming member 24 is deformed by applying a pressure caused by the pressing roller 22, and a uniform nip width is obtained across the axial direction of the pressing roller 22. Desirably, the stay 25 is formed of a metal material of high mechanical strength such as stainless steel and iron in order to satisfy a function of preventing the deformation of the nip forming member 24. Furthermore, desirably, the base pad 241 is also formed of a hard material to some extent in order to secure strength. For the material of the base pad 241, a resin such as a liquid crystal polymer (LCP), a metal, ceramics, or the like can be adapted.

The reflecting member 26 is fixed and supported by the stay 25 as facing the halogen heaters 23. The reflecting member 26 reflects off heat radiated (or light emitted) from the halogen heaters 23 to the fixing belt 21, so that it is suppressed that heat is transmitted to the stay 25 or the like, the fixing belt 21 is efficiently heated, and energy is saved. For the material of the reflecting member 26, aluminum, stainless steel, or the like is used. Particularly, in a case where such a material is used that silver is deposited on an aluminum base material of a low reflectivity (a high reflectance), the heating efficiency of the fixing belt 21 can be improved.

Figure 3:
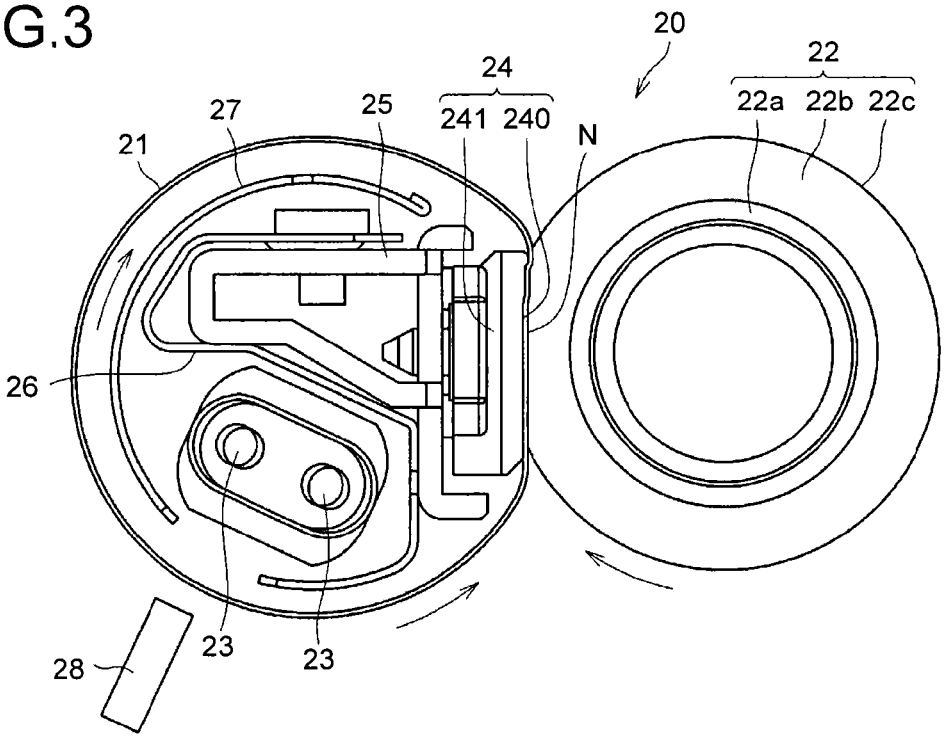
FIG. 3 is a diagram illustrating the state in which a shielding member is moved at a retraction position.

The shielding member 27 is configured in which a metal plate having a thickness of 0.1 mm to 1.0 mm is formed in an arc-shaped cross section along the inner circumferential surface of the fixing belt 21. Moreover, the shielding member 27 is movable in the circumferential direction of the fixing belt 21 as necessary. In the embodiment, in the region of the circumferential direction of the fixing belt 21, there are a direct heating region in which the halogen heaters 23 directly heat the fixing belt 21 as opposite to the fixing belt 21 and an indirect heating region in which the other members (such as the reflecting member 26, the stay 25, and the nip forming member 24) other than the shielding member 27 are provided between the halogen heaters 23 and the fixing belt 21. In a case where it is necessary to block heat, as illustrated in FIG. 2, the shielding member 27 is disposed at a shielding position on the direct heating region side. On the other hand, in a case where it is unnecessary to block heat, as illustrated in FIG. 3, it is possible that the shielding member 27 is moved to a retraction position on the indirect heating region side and the shielding member 27 is retracted on the back side of the reflecting member 26 or the stay 25. Furthermore, since the shielding member 27 needs heat-resisting properties, preferably, a metal material such as aluminum, iron, and stainless steel or ceramics is used for the material of the shielding member 27.

Figure 4:
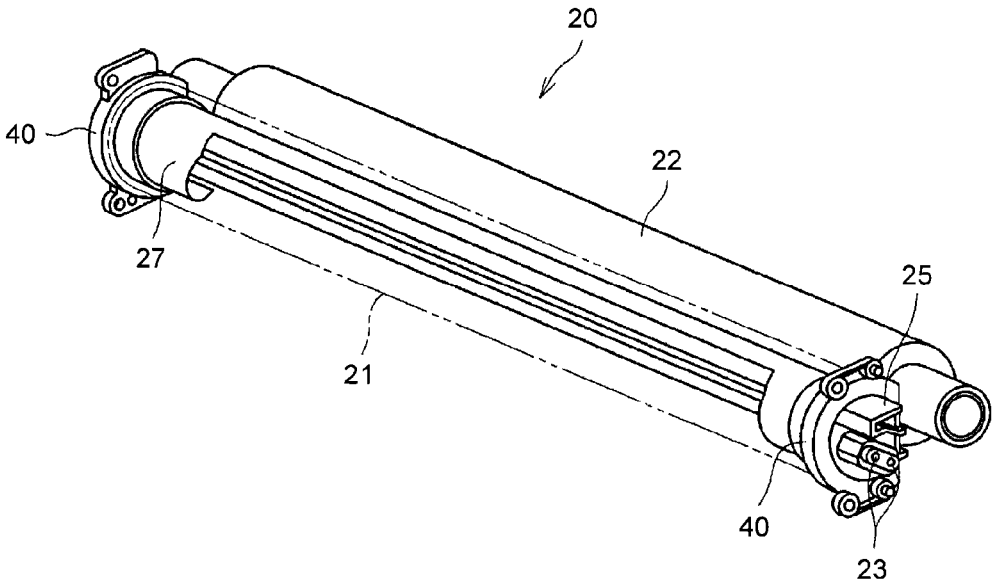
FIG. 4 is a perspective view of the fixing device.

FIG. 4 is a perspective view of the fixing device according to the embodiment.

As illustrated in FIG. 4, at the both end portions of the fixing belt 21, flange members 40 as a belt holding member are inserted into the end portions, and the fixing belt 21 is rotatably supported by the flange members 40. Moreover, the flange members 40, the halogen heaters 23, and the stay 25 are fixed and supported by a pair of side plates, not illustrated, of the fixing device 20.

Figure 5:
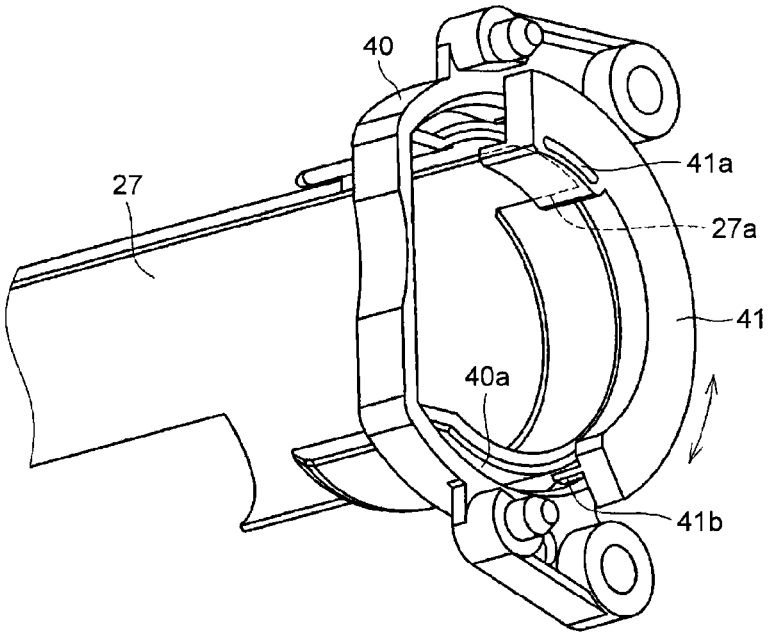
FIG. 5 is a perspective view of a support structure for the shielding member.

FIG. 5 is a perspective view of a support structure for the shielding member.

As illustrated in FIG. 5, the shielding member 27 is supported through a sliding member 41 in an arc shape mounted on the flange member 40. More specifically, a projection 27*a* provided on the end portion of the shielding member 27 is inserted into a hole 41*a* provided on the sliding member 41, whereby the shielding member 27 is mounted on the sliding member 41. Furthermore, the sliding member 41 is provided with a protrusion 41*b*. The protrusion 41*b* is inserted into a groove 40*a* in an arc shape provided on the flange member 40, whereby the sliding member 41 is slidably movable along the groove 40*a*. Thus, the shielding member 27 is rotatably movable in the circumferential direction of the flange member 40 integrally with the sliding member 41. In addition, in the embodiment, the flange member 40 and the sliding member 41 are formed of a resin.

It is noted that only the support structure of one end portion is illustrated in FIG. 5. Similarly, the other end portion is rotatably and movably held through the sliding member 41.

Figure 6:
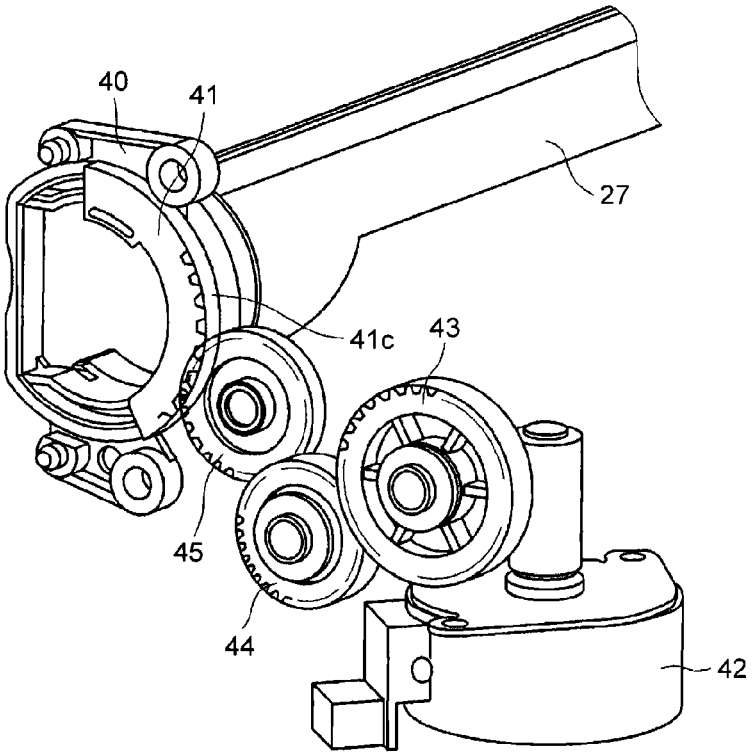
FIG. 6 is a perspective view of a drive unit for the shielding member.

FIG. 6 is a perspective view of the drive unit for the shielding member.

As illustrated in FIG. 6, in the embodiment, the drive unit for the shielding member 27 includes a motor 42 that is a driving source and a gear train formed of a plurality of transmission gears 43, 44, and 45. In the gear train, the gear 43 on one end side is joined to the motor 42, and the gear 45 on the other end side is joined to a gear portion 41*c* provided on the circumferential direction of the sliding member 41. Thus, when the motor 42 is driven, the driving force is transmitted to the sliding member 41 through the gear train, and the shielding member 27 is rotated and moved.

Figure 7:
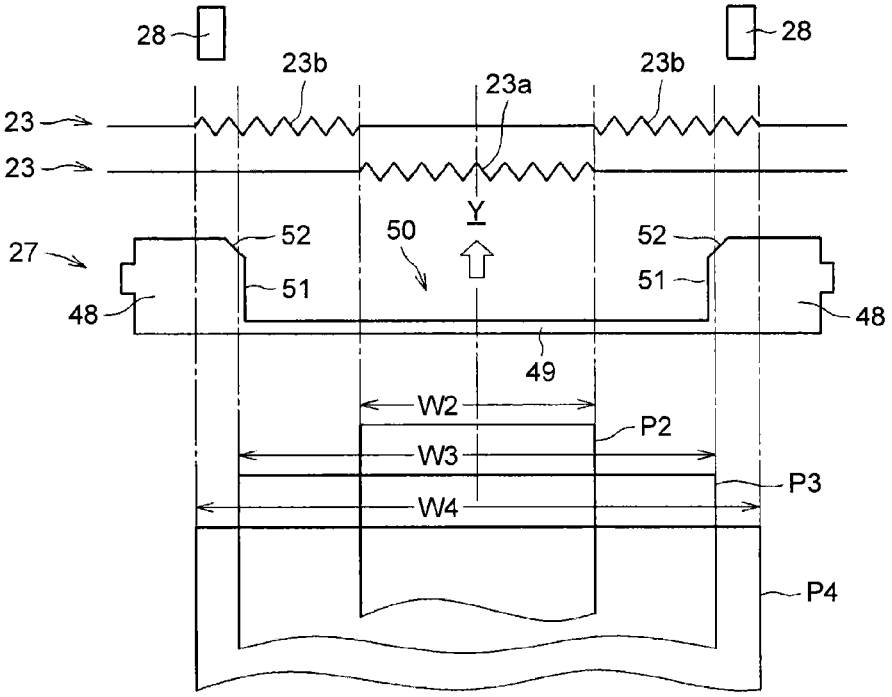
FIG. 7 is a diagram illustrating the relationship between the shape of the shielding member, heat generating units of halogen heaters, and a paper sheet size.

FIG. 7 is a diagram illustrating the relationship between the shape of the shielding member, the heat generating units of the halogen heaters, and a paper sheet size.

First, the shape of the shielding member 27 will be described in detail with reference to FIG. 7.

As illustrated in FIG. 7, the shielding member 27 according to the embodiment includes a pair of shielding portions 48 provided on the end portions to block heat from the halogen heaters 23 and a coupling portion 49 that connects the shielding portions 48 to each other. Moreover, an opening 50 is provided between the shielding portions 48, so that heat from the halogen heaters 23 is released through the opening 50 without blocking the heat.

Moreover, the inner edges of the shielding portions 48 opposite to each other are formed with a straight portion 51 in parallel with the rotation direction of the shielding member 27 and a slope 52 inclined to the rotation direction. In FIG. 7, suppose that the side on which the shielding member 27 is rotated and moved to the shielding position is a shielding side Y, the slope 52 are continuously provided on the shielding side Y of the straight portion 51, and the slopes 52 inclined apart from each other toward the shielding side Y. Thus, the opening 50 is formed to have the same width in the longitudinal direction between the straight portions 51 toward the shielding side Y, while the width is gradually increased between the slopes 52.

Next, the relationship between the heat generating units of the halogen heaters and the paper sheet size will be described.

As illustrated in FIG. 7, in the embodiment, the length of heater portions of the halogen heaters 23 and the positions of disposing the heater elements are varied because the heating region is changed according to the paper sheet size. A heater element 23*a* of one halogen heater 23 (on the lower side in FIG. 7) of the two halogen heaters 23 is disposed on the center in the longitudinal direction, and heater elements 23*b* of the other halogen heater 23 (on the upper side in FIG. 7) are disposed on the both end portions in the longitudinal direction. In this example, the heater element 23*a* on the center is disposed in a range corresponding to a paper feeding width W2 in the medium size. The heater elements 23*b* on the both end portions are disposed in a range including paper feeding widths W3 and W4 in the large size and the extra-large size greater than the paper feeding width W2 in the medium size.

In the relationship between the shape of the shielding member 27 and the paper sheet size, the straight portions 51 are disposed near the inner side in the width direction with respect to the end portions of the paper feeding width W3 in the large size, and the slopes 52 are disposed at positions across the end portions of the paper feeding width W3 in the large size.

It is noted that for examples of paper sheet sizes according to the embodiment, the medium size is the letter size (a paper feeding width of 215.9 mm) or the A4 size (a paper feeding width of 210 mm), the large size is the double letter size (a paper feeding width of 279.4 mm) or the A3 size (a paper feeding width of 297 mm), and the extra-large size is the A3+ size (a paper feeding width of 329 mm), for example. However, examples of the paper sheet sizes are not limited thereto. Moreover, the medium size, the large size, and the extra-large size here express the relative relationship between the sizes. The sizes may include the small size, the medium size, the large size, and so on.

In the following, the basic operation of the fixing device according to the embodiment will be described with reference to FIG. 2.

When the power supply switch of the printer main body is turned on, electric power is supplied to the halogen heaters 23, and the pressing roller 22 starts clockwise rotation in FIG. 2. Thus, the fixing belt 21 follows the counterclockwise rotation in FIG. 2 caused by the friction with the pressing roller 22.

After that, a paper sheet P on which an unfixed toner image T is held is carried in the direction of an arrow A1 in FIG. 2 as guided by a guide plate, not illustrated, in the image forming process steps described above, and delivered to the nip portion N between the fixing belt 21 and the pressing roller 22 in the state in which the fixing belt 21 and the pressing roller 22 are pressed against each other. The toner image T is then fixed to the surface of the paper sheet P due to the heat of the fixing belt 21 heated by the halogen heaters 23 and the application of a pressure across the fixing belt 21 and the pressing roller 22.

The paper sheet P on which the toner image T is fixed is transferred from the nip portion N to the direction of an arrow A2 in FIG. 2. At this time, the leading end of the paper sheet P comes into contact with the leading end of a separating member, not illustrated, and the paper sheet P is separated from the fixing belt 21. After that, the separated paper sheet P is ejected out of the apparatus by the discharging roller as described above, and stored in the discharge tray.

Next, control on the halogen heaters and control on the shielding member for individual paper sheet sizes will be described.

First, in a case where a medium-sized paper sheet P2 illustrated in FIG. 7 is fed, only the heater element 23*a* on the center is caused to generate heat to heat only the range corresponding to the paper feeding width W2 in the medium size. Moreover, in a case where an extra-large-sized paper sheet P4 is fed, the heater element 23*a* on the center as well as the heater elements 23*b* on the both end portions are caused to generate heat to heat a range corresponding to the paper feeding width W4 in the extra-large size.

However, in the embodiment, the heating range of the halogen heaters 23 corresponds only to the paper feeding width W2 in the medium size and the paper feeding width W4 in the extra-large size. Thus, in a case where a large-sized paper sheet P3 is fed, when only the heater element 23*a* on the center is caused to generate heat, a necessary range is not heated, whereas when the heater elements 23*a* and 23*b* on the center and on the both end portions are caused to generate heat, the range to be heated exceeds the paper feeding width W3 in the large size. Supposing that when the large-sized paper sheet P3 is fed as it is, in the state in which the heater elements 23*a* and 23*b* on the center and on the both end portions are caused to generate heat, a problem arises in that the temperature of the fixing belt 21 is excessively increased in the non-paper feeding region on the outer side of the paper feeding width W3 in the large size.

Figure 8:
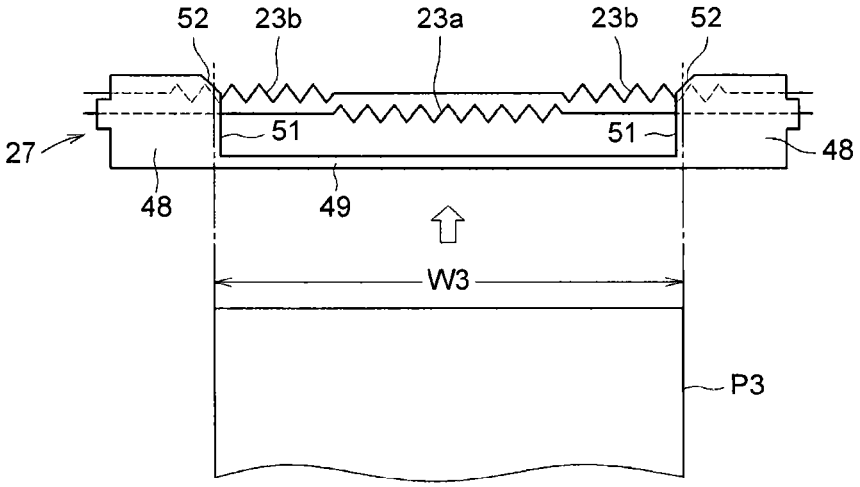
FIG. 8 is a diagram illustrating the state in which the shielding member is moved at a shielding position.

Therefore, in the embodiment, in feeding the large-sized paper sheet P3, the shielding member 27 is moved at the shielding position as illustrated in FIG. 8. Thus, the range from the vicinity of the end portions to the outer side of the paper feeding width W3 in the large size can be covered using the shielding portions 48 disposed on the end portion sides, so that the temperature increase in the fixing belt 21 can be suppressed in the non-paper feeding region.

Moreover, in a case where it is unnecessary to block heat as in the case where the fixing process is finished, or in a case where the temperature of the fixing belt 21 in the non-paper feeding region reaches a predetermined threshold or less, for example, the shielding member 27 is returned at the retraction position. As described above, the shielding member 27 is moved at the shielding position as necessary, so that excellent fixing can be performed without reducing paper feeding speed.

Moreover, in the embodiment, the slopes 52 are provided on the shielding portions 48, so that the range covering the heater elements 23*b* can be adjusted using the shielding portions 48 by changing the rotational position of the shielding member 27. For example, the temperature of the fixing belt 21 tends to be increased in the non-paper feeding region when the number of paper sheets fed or paper feeding time is increased. Therefore, when the number of paper sheets fed reaches a predetermined number of sheets or when paper feeding time reaches a predetermined time period, the shielding member 27 is rotated in the direction of covering the heater elements 23*b* disposed on the end portion sides, so that the temperature increase can be suppressed at high degree.

It is noted that desirably, the temperature sensor 28 that detects the temperature of the fixing belt 21 is disposed in a region in which a temperature increase is noticeable in the axial direction of the fixing belt 21.

In the case of the embodiment, since the temperature tends to increase particularly in the region on the outer side of the paper feeding width W3 in the large size, so that desirably, the temperature sensor 28 is disposed on the outer side of the paper feeding width W3 in the large size (see FIG. 7). Furthermore, in the embodiment, among two halogen heaters 23, the halogen heater 23 having the heater elements 23*b* on the end portions considerably causes the temperature increase, so that desirably, the temperature sensor 28 is disposed at the position opposite to the heater elements 23*b* of the halogen heater 23.

Figure 9:
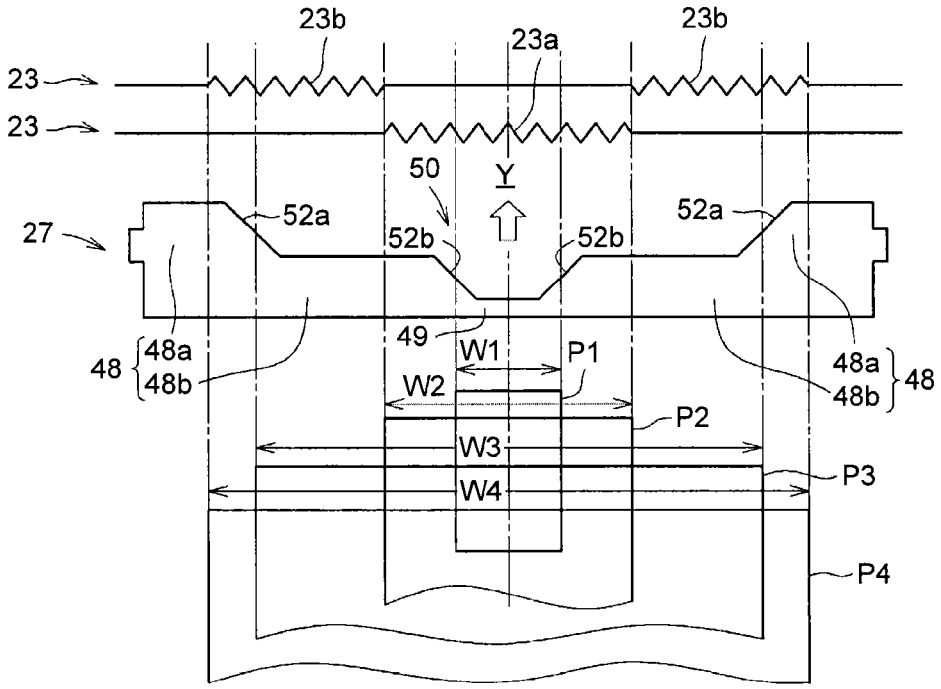
FIG. 9 is a diagram illustrating another example of the shielding member.

FIG. 9 illustrates another example of the shielding member.

In a shielding member 27 illustrated in FIG. 9, shielding portions 48 on the end portions are formed to include two steps. Namely, the shielding portions 48 are each configured of a small shielding portion 48*a* in a small width in the longitudinal direction and a large shielding portion in a large width in the longitudinal direction. The large shielding portions 48*b* are connected to each other through a coupling portion 49. The small shielding portion 48*a* is continuously provided on the shielding side Y of the large shielding portion 48*b*. Furthermore, slopes 52*a* and 52*b* inclined apart from each other toward the shielding side Y are provided on the inner edges of the small shielding portions 48*a* opposite to each other and the inner edges of the large shielding portions 48 opposite to each other. Here, the straight portion 51 of the shielding member 27 illustrated in FIG. 7 is not formed.

In the embodiment illustrated in FIG. 9, at least four kinds of paper sheets are used, a small-sized paper sheet P1, a medium-sized paper sheet P2, a large-sized paper sheet P3, and an extra-large-sized paper sheet P4. For examples of the paper sheet sizes in the embodiment, the small size is the postcard size (a paper feeding width of 100 mm), the medium size is the A4 size (a paper feeding width of 210 mm), the large size is the A3 size (a paper feeding width of 297 mm), and the extra-large size is the A3+ size (a paper feeding width of 329 mm), for example. However, examples of the paper sheet sizes are not limited thereto.

Here, a paper feeding width W1 of the small-sized paper sheet P1 is in the range smaller than the length of the heat generating unit 23*a* on the center. Moreover, in the relationship with the shape of the shielding member 27, the slopes 52*b* of the large shielding portions 48*b* are disposed at positions across the end portions of the paper feeding width W1 in the small size. The slopes 52*a* of the small shielding portions 48*a* are disposed at positions across the end portions of the paper feeding width W3 in the large size. It is noted that the position relationship between the paper sheet sizes (the medium size, large size, and extra-large size) other than the small size and the heat generating units 23*a* and 23*b* are the same as the embodiment, and the description is omitted.

Figure 10:
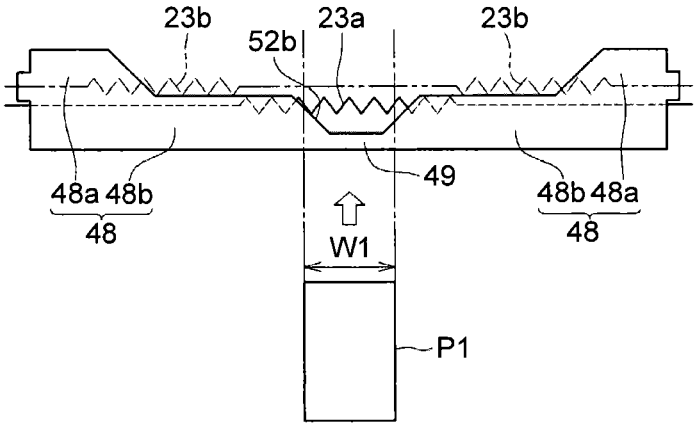
FIG. 10 is a diagram illustrating the state in which the shielding member is moved at a shielding position.

In a case where the small-sized paper sheet P1 is fed, only the heater element 23*a* on the center is caused to generate heat. However, in this case, since the range to be heated by the heater element 23*a* on the center exceeds the paper feeding width W1 in the small size, the shielding member 27 is moved at the shielding position as illustrated in FIG. 10. Thus, the range from the vicinity to the outer side of the end portions of the paper feeding width W1 in the small size can be covered using the large shielding portions 48*b*, so that the temperature increase in the non-paper feeding region of a fixing belt 21 can be suppressed.

It is noted that control on the halogen heaters 23 and the shielding member 27 in feeding paper sheets in other sizes (in the medium size, large size, and extra-large size) is basically the same as in the embodiment. In this case, the small shielding portion 48*a* serves as the function as the shielding portion 48 in the embodiment.

Moreover, also in the case of the embodiment illustrated in FIG. 9, the slopes 52*a* and 52*b* are provided on the small shielding portion 48*a* and the large shielding portion 48*b*, respectively, as similar to the shielding portion 48 according to the embodiment, so that the range covering the heater elements 23*a* and 23*b* can be adjusted using the shielding portions 48*a* and 48*b* by changing the rotational position of the shielding member 27.

Meanwhile, in the configuration in which the nip forming member 24 is provided on the inner side of the fixing belt 21 as described above, it is necessary that the shielding member 27 be formed in a shape having ends, not in a ring shape, in the circumferential direction across the entire of the recording medium feeding region in the width direction (across the maximum paper feeding range including a plurality of the kinds of paper feeding widths in the case where there is the plurality of the kinds of paper feeding widths), in order that the shielding member 27 avoids the interference with the nip forming member 24. However, when the shielding member 27 is formed in a shape having ends in the circumferential direction, thermal deformation may occur at the end portions of the shielding member 27 in the circumferential direction being curled up outwardly or inwardly in a case where the shielding member 27 is excessively heated.

Furthermore, in a case where the shielding member 27 is rotatably and movably configured as in the embodiment, it is necessary to secure driving properties between the members to support the shielding member 27 (between the flange member 40 and the sliding member 41). Therefore, it is necessary to provide an allowance (a gap) between the support members to some extent. However, in this case, the effect of dissipating the heat of the shielding member 27 through the support members is degraded as compared with the case where the shielding member 27 is fixed to the side plate or the like. This is not applied only to the configuration of the embodiment. Thus, in a case of a movable shielding member in general, heat is prone to be stored more than in a fixed shielding member, and it is likely to increase the occurrence of thermal deformation.

Furthermore, in the embodiment, since the face of the reflecting member 26 opposite to the halogen heaters 23 is formed so as to become wide toward the inner circumferential surface of the fixing belt 21 (see FIG. 2), the area that light from the halogen heaters 23 is applied to the shielding member 27 is increased, and the shielding member 27 is in the situations that the shielding member 27 is prone to be heated.

It is noted that in the reflecting member 26 illustrated in FIG. 2, the portion opposite to the portion below the halogen heaters 23 is provided to block heat at the end portions of the halogen heaters 23, and is not provided across the longitudinal direction of the reflecting member 26.

Therefore, in the present invention, a configuration is provided to prevent the thermal deformation of the shielding member as described above.

Figure 11:
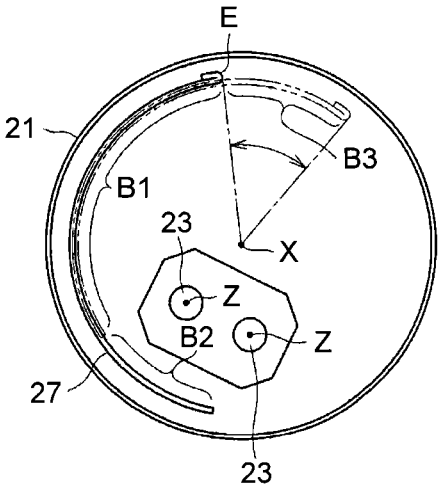
FIG. 11 is a diagram illustrating the position relationship between the shielding member and the halogen heater.

In a cross sectional view of the fixing belt 21 in the circumferential direction illustrated in FIG. 11, suppose that the rotation center of the shielding member 27 is X and the centers of the halogen heaters 23 are Z. In the present invention, the rotation center X of the shielding member 27 is disposed at a position different from the centers Z of the halogen heaters 23. It is noted that the center of the halogen heater 23 here means the center of a filament included in the halogen heater 23.

As described above, the rotation center X of the shielding member 27 is disposed at a position different from the centers Z of the halogen heaters 23, so that the shielding member 27 comes close to the halogen heaters 23 at the shielding position (the position indicated by solid lines in FIG. 11), whereas the shielding member 27 is apart from the halogen heaters 23 at the retraction position (the position indicated by dashed double-dotted lines in FIG. 11). Thus, the shielding member 27 does not tend to be affected by heat from the halogen heaters 23 at the retraction position, so that the temperature increase in the shielding member 27 itself can be suppressed.

Moreover, in the embodiment, when the shielding member 27 is moved to the retraction position, a part of the shielding member 27 is moved to the back side of the reflecting member 26 or the stay 25 (to the opposite side of the halogen heaters 23, or to the indirect heating region side), so that the shielding member 27 does not further tend to be affected by heat from the halogen heaters 23. In this case, although the reflecting member 26 or the stay 25 functions as a heat suppressing member to suppress the heating of the shielding member 27, a member other than the reflecting member 26 and the stay 25 may be used as a heat suppressing member. Furthermore, a dedicated heat suppressing member may be provided. It is noted that in order to suppress the heating of the shielding member 27 at high degree, it is preferable to move the shielding member 27 entirely to the back side of other members such as the reflecting member 26 and the stay 25. However, the effect of suppressing heating is also obtained when a part of the shielding member 27 is moved to the back side of other members such as the reflecting member 26 and the stay 25.

In addition, when the shielding member 27 is moved to the shielding position, it is desirable that the shielding member 27 be entirely apart from the halogen heaters 23. However, such a portion may be provided in which a distance from the halogen heaters 23 is not changed so much before and after moving the shielding member 27. For example, in the embodiment illustrated in FIG. 11, even though the shielding member 27 is moved to the retraction position, a distance to the halogen heaters 23 is not changed in a range indicated by B1 in FIG. 11. In this case, the shielding member 27 is moved to the retraction position, so that a nearby region B2 close to the halogen heaters 23 can be reduced, and a distant region B3 far from the halogen heaters 23 can be increased. Thus, the shielding member 27 can be in the state in which the shielding member 27 does not tend to be heated as a whole.

Figure 12:
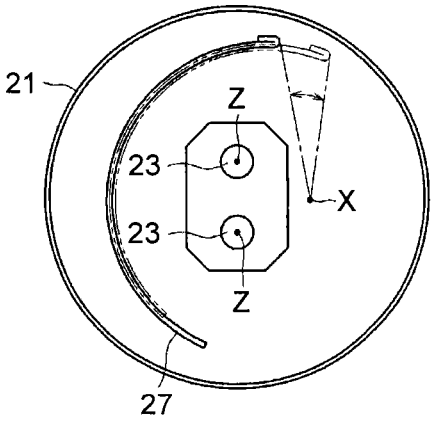
FIG. 12 is a diagram of an example in which the centers of the halogen heaters are disposed close to the center of a fixing belt.

In the embodiment illustrated in FIG. 11, the rotation center X of the shielding member 27 is disposed close to the center of the fixing belt 21 in a cross section in the circumferential direction, and the centers Z of the halogen heaters 23 are disposed on the inner circumferential surface side of the fixing belt 21, not close to the rotation center X of the shielding member 27. On the contrary, such a configuration may be possible in which as illustrated in FIG. 12, the centers Z of the halogen heaters 23 are disposed close to the center of the fixing belt 21. However, in the example illustrated in FIG. 12, in a case of using the shielding member 27 in the size the same as the size of the shielding member 27 illustrated in FIG. 11, it is difficult to secure a large travel in retracting the shielding member 27. In this case, the travel can be secured when the size of the shielding member 27 is reduced in the circumferential direction. However, when the size of the shielding member 27 is reduced in the circumferential direction, a shieldable range is reduced, or it is difficult to form a shape having a plurality of steps as illustrated in FIG. 9.

On the contrary, as illustrated in FIG. 11, in a case where the rotation center X of the shielding member 27 is disposed close to the center of the fixing belt 21 in a cross section in the circumferential direction, a moving stroke of the shielding member 27 can be large while maintaining the size of the shielding member 27 in the circumferential direction. Therefore, with this configuration, an excellent heat shielding function can be obtained, and a distance between the shielding member 27 and the halogen heaters 23 can be secured in retraction. Moreover, in the embodiment illustrated in FIG. 11, the halogen heaters 23 are disposed at positions close to the inner circumferential surface of the fixing belt 21, so that the fixing belt 21 can also be efficiently heated.

Furthermore, as described above, in the configuration in which the nip forming member 24 is provided in the inside of the fixing belt 21, it is difficult to retract the shielding member 27 to the nip portion N side. Therefore, in the embodiment, the halogen heaters 23 are disposed on the upstream side of the nip portion N in the paper sheet transfer direction, and the shielding member 27 is movable between the shielding position on the upstream side and the retraction position on the downstream side. Thus, the shielding member 27 can be retracted with no interference with the nip forming member 24, and a moving stroke of the shielding member 27 can be large. In addition, such a configuration is preferable in which a moving stroke of the shielding member 27 can be large because the space on the inner side of the fixing belt 21 is particularly reduced in the configuration in which the diameter of the fixing belt 21 is reduced for the purpose of a low heat capacity.

As described above, according to the present invention, the heating of the shielding member can be suppressed, so that the deformation of the shielding member caused by heat can be suppressed. Thus, the degradation of the function of the shielding member caused by the thermal deformation and the interference of a deformed portion with the other members can be avoided, and the reliability of the apparatus can be improved. Particularly, it is effective to adapt the present invention in the configuration in which the shielding member is in a shape with ends in the circumferential direction and movable because it is likely to produce the thermal deformation of the shielding member.

The foregoing description is an example, and the first embodiment includes the following aspects (1) to (10).

(1) A fixing device includes a rotatable fixing member; a heating source configured to heat the fixing member; an opposing member configured to come into contact with an outer circumferential surface of the fixing member to form a nip portion; and a shielding member configured to block heat from the heating source. The shielding member is configured to rotate about a position different from the center of the heating source so as to be movable between a shielding position and a retraction position, the shielding position being a position where the shielding member comes close to the heating source to block heat from the heating source to the fixing member, the retraction position being a position where the shielding member is retracted away from the shielding position.

(2) In the fixing device according to aspect (1), the fixing member is a tubular member including therein the heating source and the shielding member, the shielding member is arranged such that the rotation center thereof is disposed close to the center of the fixing member in a cross section in a circumferential direction of the fixing member, and the heating source is arranged such that the center thereof is disposed close to an inner circumferential surface of the fixing member rather than the rotation center of the shielding member in the cross section in the circumferential direction of the fixing member.

(3) In the fixing device according to aspect (1) or (2), the fixing member is an endless fixing belt, and the fixing device further includes a nip forming member configured to come into contact with the opposing member from an inner circumferential side of the fixing belt to form the nip portion.

(4) In the fixing device according to aspect (3), the heating source is disposed on an inner circumferential side of the fixing belt and on an upstream side of the nip portion in a recording medium transfer direction, and the shielding member is arranged on the upstream side of the nip portion in the recording medium transfer direction at the shielding position, while the shielding member is arranged on a downstream side of the nip portion in the recording medium transfer direction at the retraction position.

(5) In the fixing device according to any one of aspects (1) to (4), the shielding member is configured such that, when the shielding member is rotated and moved from the shielding position to the retraction position, a nearby region of the shielding member close to the heating source is reduced and a distant region of the shielding member far from the heating source is increased.

(6) In the fixing device according to any one of aspects (1) to (5), the heating source includes a direct heating region in which the heating source directly heats the fixing member as facing the fixing member and an indirect heating region in which another member other than the shielding member is provided between the heating source and the fixing member, and the shielding member is disposed on the direct heating region side at the shielding position, and the shielding member is disposed on the indirect heating region side at the retraction position.

(7) In the fixing device according to any one of aspects (1) to (6), the fixing member is an endless fixing belt, the fixing device further includes a nip forming member configured to come into contact with the opposing member from an inner circumferential side of the fixing belt to form the nip portion; and a support member configured to support the nip forming member, and when the shielding member is rotated and moved from the shielding position to the retraction position, at least a part of the shielding member is moved to an opposite side of the support member with respect to the heating source.

(8) In the fixing device according to any one of aspects (1) to (7), the fixing device further includes a reflecting member configured to reflect heat from the heating source to the fixing member. When the shielding member is rotated and moved from the shielding position to the retraction position, at least a part of the shielding member is moved on an opposite side of the reflecting member with respect to the heating source.

(9) In the fixing device according to any one of aspects (1) to (8), the fixing device includes a plurality of the heating sources. The rotation center of the shielding member is disposed at a position different from the centers of the plurality of the heating sources.

(10) An image forming apparatus includes the fixing device according to aspect (1).

According to the first embodiment, the shielding member is moved to the retraction position, and the shielding member can be set apart from the heating source, so that the shielding member does not tend to be affected by heat from the heating source at the retraction position. Thus, a temperature increase in the shielding member can be suppressed.

Second Embodiment

A second embodiment will be described with reference to the configurations of the image forming apparatus and the fixing device described above. It is noted that the same reference numerals and signs are used for functional components the same as the functional components referred in the first embodiment, and the overlapping description is omitted.

Figure 15:
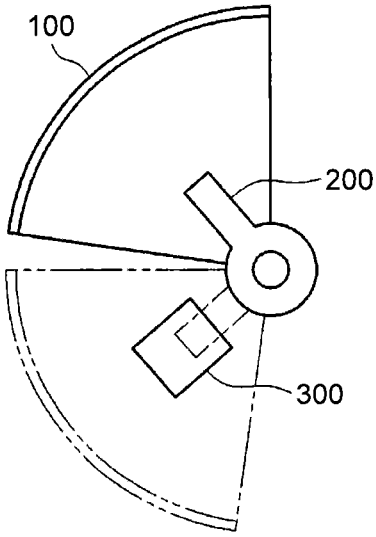
FIG. 15 is a diagram of a position detecting unit according to a comparative example.

In order to dispose a shielding member at an appropriate position according to the paper sheet size, it is necessary to provide a position detecting unit that detects a rotational position of the shielding member to control the rotational position. The position detecting unit is, for example, a position detecting unit including a feeler 200 as a detected unit operating together with a shielding member 100 and a photointerrupter 300 as a detection sensor that detects the position of the feeler 200 as illustrated in FIG. 15. In this case, the feeler 200 is provided between the light-emitting element and the light receiving unit of the photointerrupter 300 and blocked from light in association with the rotation of the shielding member 100, and it is detected that the shielding member 100 reaches a position indicated by dashed double-dotted lines in FIG. 15 from a position indicated by a solid line in FIG. 15 (an initial position). Moreover, in this case, when the printing operation (the fixing process) is finished, the shielding member 100 is returned at the initial position.

However, in a case where the image forming apparatus is stopped in the midway point of the operation due to a paper jam or other abnormalities or in the case where the fixing device is detached or attached, it is likely that the shielding member is not returned at the initial position. In this case, it is necessary to perform an operation of returning the shielding member to the initial position in the starting up operation of the image forming apparatus, for example. However, in the returning operation, when time necessary to return the shielding member to the initial position is prolonged, a problem arises in that the warm-up period when starting up the apparatus is prolonged (time necessary to increase the temperature from a room temperature state to a predetermined temperature (a reload temperature) at which printing is possible such as time to turn on a power supply).

Figure 16:
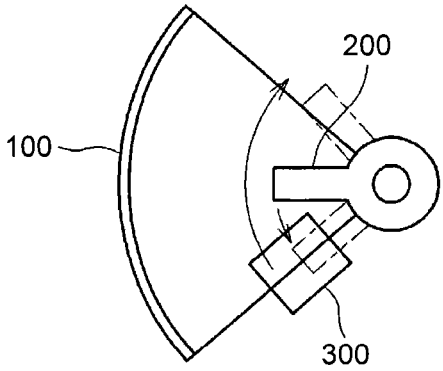
FIG. 16 is a diagram illustrating the operation of returning a shielding member at an initial position in a case of using the position detecting unit according to the comparative example.

More specifically, as illustrated in FIG. 16, in a case where the feeler 200 is stationary at the position between the initial position and the photointerrupter 300, first, it is necessary to temporarily rotate the shielding member 100 on the photointerrupter 300 side on the opposite side of the initial position in order to grasp the position of the shielding member 100. The photointerrupter 300 then detects the feeler 200, and the shielding member 100 is moved to the initial position by controlling the pulse of a stepping motor, for example. However, as described above, when the shielding member 100 is temporarily moved on the opposite side of the initial position, it takes extra time by the temporal movement.

Therefore, in this embodiment, a configuration is provided in which the shielding member is quickly returned at the initial position.

Figure 13:
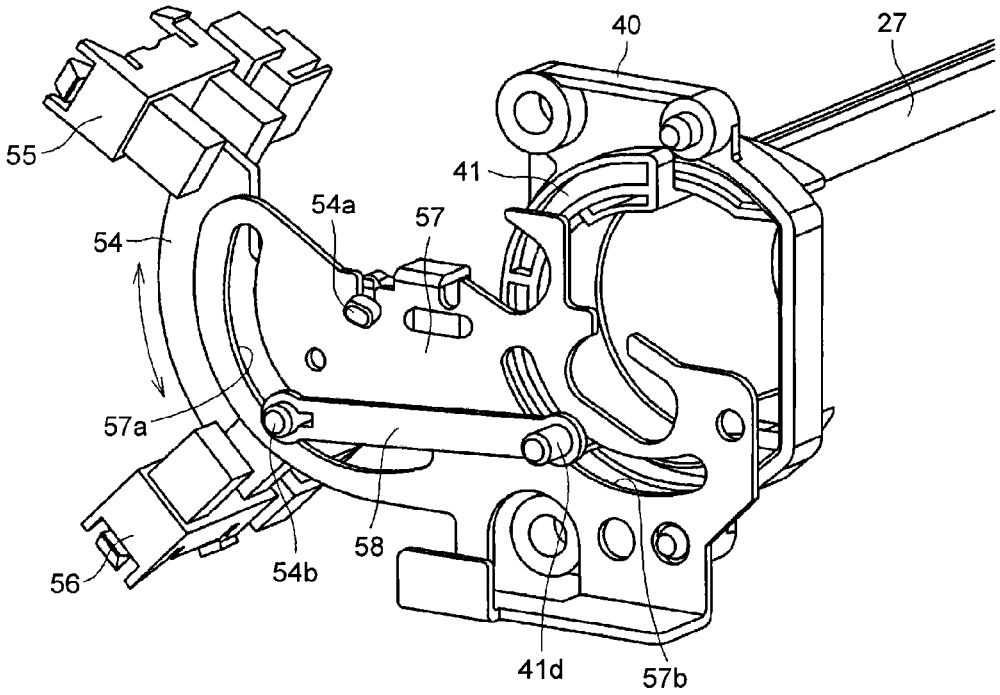
FIG. 13 is a perspective view of a position detecting unit that detects the position of the shielding member.

FIG. 13 is a perspective view of a position detecting unit for a shielding member according to the embodiment.

Here, the position detecting unit includes a single feeler 54 that is a member to be detected (a to-be-detected member) and two photointerrupters 55 and 56 that are detection sensors to detect the position of the member to be detected. It is noted that any detector other than the feeler and the photointerrupter may be used as the position detecting unit.

The feeler 54 is formed in an almost fan shape and is rotatable about a fulcrum 54*a* mounted on a support plate 57. The feeler 54 can operate together with a shielding member 27 through a link member 58. In detail, the end portions of the link member 58 are connected to a projecting portion 54*b* provided on the feeler 54 and a projecting portion 41*d* provided on a sliding member 41. Thus, when the sliding member 41 holding the shielding member 27 is rotated along the flange member 40, the feeler 54 is rotated about the fulcrum 54*a* in association with the rotation. In this way, the feeler 54 operates together through the link member 58, whereby the position of the shielding member 27 can be detected even in a case where the feeler 54 and the photointerrupters 55 and 56 are not allowed to be disposed near the shielding member 27 and the sliding member 41 because of the layout.

Furthermore, the support plate 57 is formed with two guide portions 57*a* and 57*b* in an arc-shaped groove along rotation tracks of the projecting portion 54*b* of the feeler 54 and the projecting portion 41*d* of the sliding member 41. In rotating the feeler 54 and the sliding member 41, the projecting portions 54*b* and 41*d* are moved along the guide portions 57*a* and 57*b*, so that the feeler 54 and the sliding member 41 stably operate together with each other.

The two photointerrupters 55 and 56 are fixed to a frame, not illustrated, of a printer main body, for example. Each of the photointerrupters 55 and 56 includes a light-emitting element that emits light and a light receiving unit that receives the light as similar to the foregoing description. When the end portion of the feeler 54 enters between the light-emitting element and the light receiving unit to block light, or when the end portion of the feeler 54 gets out between the light-emitting element and the light receiving unit and light is transmitted, the photointerrupter detects that the shielding member 27 reaches a predetermined rotational position.

In the embodiment, the photointerrupter 55 (on the upper side in FIG. 13) is used as an initial position detecting unit that detects the initial position of the shielding member 27 between the two photointerrupters 55 and 56. In the case where the shielding member 27 is returned to the initial position as in a case where the printing operation (the fixing process) is finished, the photointerrupter 55 for the initial position detects the feeler 54.

The photointerrupter 56 (on the lower side in FIG. 13) is used as a position detecting unit for checking, and detects the position of the shielding member 27 at a position different from the initial position. Basically, the rotational position of the shielding member 27 is controlled by adjusting the pulse amount of a stepping motor, not illustrated. The photointerrupter 56 for checking is used to improve the reliability of the recognition of the position of the shielding member 27. It is noted that a DC motor or the like may be used instead of a stepping motor.

Furthermore, in a case where the printer is stopped in the midway point of the operation because of some abnormality, or in a case where the fixing device is detached from or attached to the printer main body, an operation is performed in which the shielding member 27 is returned to the initial position in the starting up operation of the printer. At this time, when the shielding member 27 is stationary at a given position other than the initial position, the shielding member 27 is directly moved on the initial position side, and the feeler 54 is detected using the photointerrupter 55 for the initial position.

Figure 14:
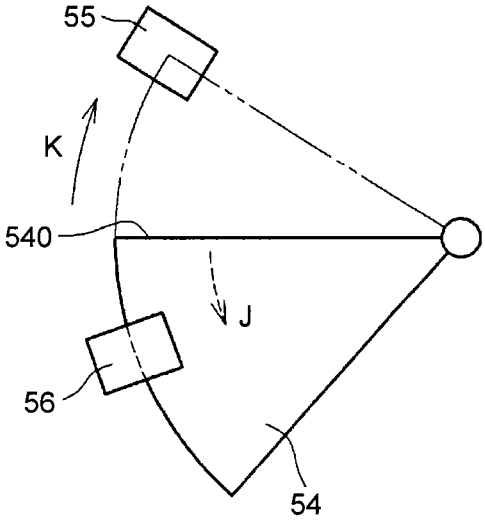
FIG. 14 is a diagram illustrating the operation of returning the shielding member at an initial position.

For example, as illustrated in FIG. 14, even in a case where the middle portion of the arc of the feeler 54 positions at the photointerrupter 56 for checking, the feeler 54 is rotated to the photointerrupter 55 side for the initial position (in the direction of an arrow K in FIG. 14), and the shielding member 27 is directly moved to the initial position. Namely, in this case, it is unnecessary to move the shielding member 27 to the opposite side of the initial position (below an arrow J in FIG. 14) in order to temporarily detect an end portion 540 of the feeler 54 using the photointerrupter 56 for checking.

As described above, according to the embodiment, even in a case where the shielding member becomes stationary at any position due to an abnormality or the like, the initial position detecting unit can directly detect the position of the shielding member without temporarily detecting the position of the shielding member using a different position detecting unit. Thus, time necessary to return the shielding member to the initial position is shortened, so that the warm-up period in the starting up operation of the image forming apparatus can be reduced.

The initial position may be appropriately set depending on the configuration and the use form of the printer, for example. In the embodiment, the initial position is set as corresponding to the paper feeding width that is predicted as the width used at the highest frequency.

For example, in the case in which the shielding portions each include one step (see FIG. 7), the width (a paper feeding width of 279.4 mm) when feeding a paper sheet in the double letter size in the portrait orientation, or when feeding a paper sheet in the letter size in the landscape orientation is the paper feeding width that is predicted as the width used at the highest frequency. Therefore, in this case, the shielding position at which the shielding member 27 is disposed is the initial position when feeding a paper sheet in the double letter size in the portrait orientation, or when feeding a paper sheet in the letter size in the landscape orientation.

In the case in which the shielding portions each include two steps (see FIG. 9), the width (a paper feeding width of 297 mm) when feeding a paper sheet in the A3 size in the portrait orientation, or when feeding a paper sheet in the A4 size in the landscape orientation is the paper feeding width that is predicted as the width used at the highest frequency. Therefore, in this case, the shielding position at which the shielding member 27 is disposed is set to the initial position when feeding a paper sheet in the A3 size in the portrait orientation, or when feeding a paper sheet in the A4 size in the landscape orientation.

As described above, the initial position is set to the position corresponding to the paper feeding width that is predicted as the width used at the highest frequency, so that the frequency of moving the shielding member can be reduced, and the warm-up period when starting up the apparatus or first print output time (time after receiving a print request, printing is prepared, the print operation is performed, and then discharging a paper is completed) can be reduced.

The foregoing description is an example, and the second embodiment includes the following aspects (1) to (7).

(1) A fixing device includes a rotatable fixing member; a heating source configured to heat the fixing member using radiant heat; an opposing member configured to come into contact with an outer circumferential surface of the fixing member to form a nip portion; and a shielding member configured to block heat from the heating source. The shielding member is configured to be movable between an initial position set in advance and a position different from the initial position according to a width size of a recording medium passing through the nip portion, and the fixing device further includes an initial position detecting unit configured to detect an initial position of the shielding member.

(2) In the fixing device according to aspect (1), the fixing member is an endless fixing belt, and the fixing device further includes a nip forming member configured to come into contact with the opposing member from an inner circumferential side of the fixing belt to form the nip portion.

(3) In the fixing device according to aspect (1) or (2), the initial position is a position at which the shielding member is disposed when feeding a recording medium in an A3 size in the portrait orientation or when feeding a recording medium in an A4 size in the landscape orientation through the nip portion.

(4) In the fixing device according to aspect (1) or (2), the initial position is a position at which the shielding member is disposed when feeding a recording medium in a double letter size in the portrait orientation or when feeding a recording medium in a letter size in the landscape orientation through the nip portion.

(5) In the fixing device according to any one of aspects (1) to (4), the initial position detecting unit includes a to-be-detected member configured to operate together with the shielding member and a detection sensor configured to detect a position of the to-be-detected member.

(6) In the fixing device according to aspect (5), the to-be-detected member is connected to the shielding member through a link member.

(7) An image forming apparatus includes the fixing device according to any one of aspects (1) to (6).

According to the second embodiment, the initial position detecting unit can directly detect the initial position of the shielding member, so that time necessary to return the shielding member to the initial position can be shortened.

Third Embodiment

A third embodiment will be described with reference to the configurations of the image forming apparatus and the fixing device described above. It is noted that the same reference numerals and signs are used for functional components the same as the functional components referred in the first embodiment, and the overlapping description is omitted.

Figure 17:
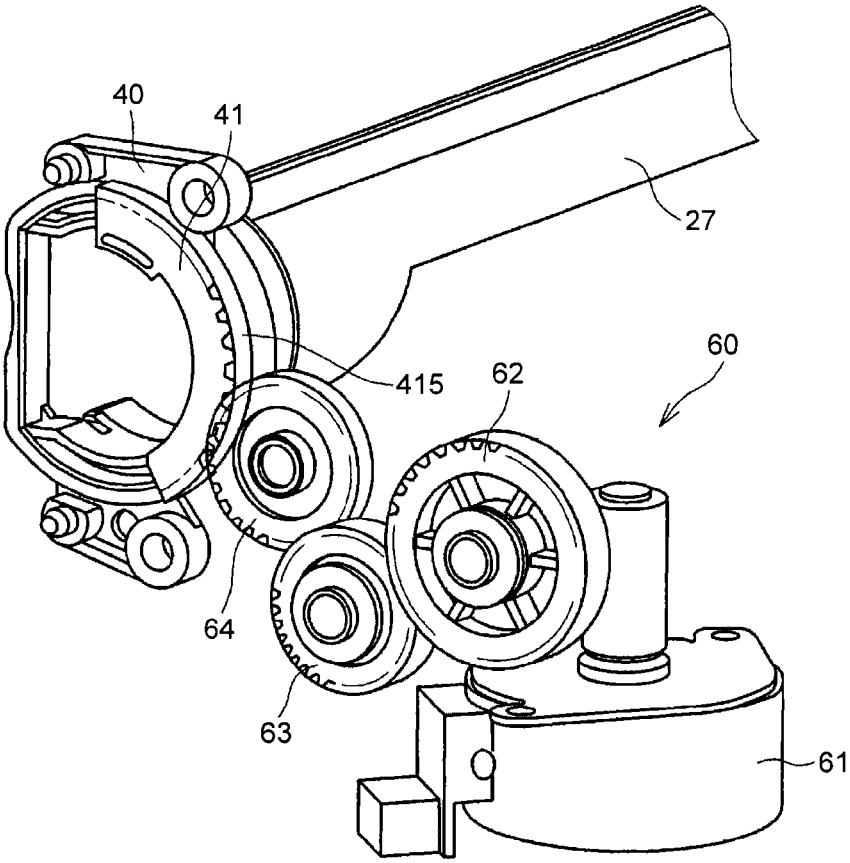
FIG. 17 is a perspective view of a driving mechanism of the shielding member.

FIG. 17 is a perspective view of a driving mechanism 60 that rotates a shielding member 27 in forward and reverse directions.

As illustrated in FIG. 17, the driving mechanism 60 is disposed on one end side of the shielding member 27 in the axial direction (on the left side in FIG. 18), including a motor 61 that is a driving source and a gear train formed of a plurality of transmission gears 62, 63, and 64. In the gear train, the gear 62 on one end side is joined to the output shaft of the motor 61. The gear 64 on the other end side engages a gear portion 415 formed on the outer circumferential surface of a sliding member 41 (described in detail). Thus, when the motor 42 is driven in the forward and reverse directions, the driving force is transmitted to the sliding member 41 through the gear train, and the shielding member 27 is rotated in the forward and reverse directions.

Figure 18:
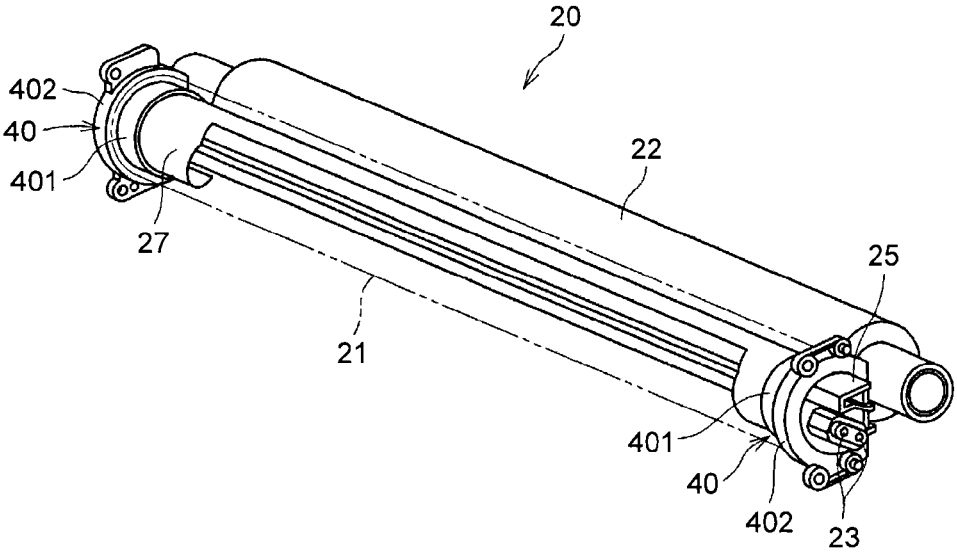
FIG. 18 is a perspective view of the fixing device.
Figure 19:
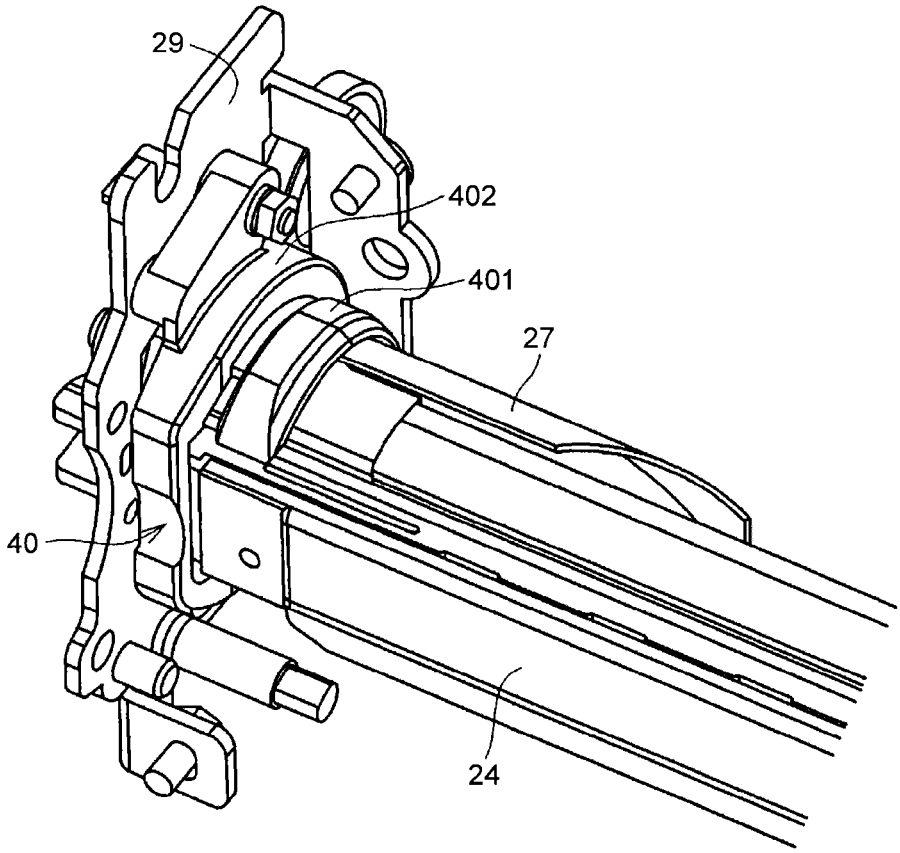
FIG. 19 is a perspective view of a support structure for the fixing belt.

FIG. 18 is a perspective view of a support structure for a fixing belt 21, and FIG. 19 is a perspective view of the support structure at the end portion of the shielding member 27 on a non-drive side (on the right side in FIG. 18), in which the support structure is reversed upside down and seen from the nip portion N side. It is noted that in the following description, the terms "the axial direction", "the circumferential direction", and "the radial direction" mean directions based on the rotating axis of the shielding member 27. For example, the axial direction matches the longitudinal direction of the shielding member 27.

As illustrated in FIG. 18, the fixing belt 21 is rotatably supported by the flange members 40 disposed at two ends of the fixing belt 21 in the axial direction. As illustrated in FIG. 19, the flange member 40 is detachably mounted on a side plate 29 of the fixing device 20 using a screw or the like.

As illustrated in FIG. 17, the shielding member 27 is rotatably supported by the support structure including the flange member 40 and the sliding member 41.

Figure 20:
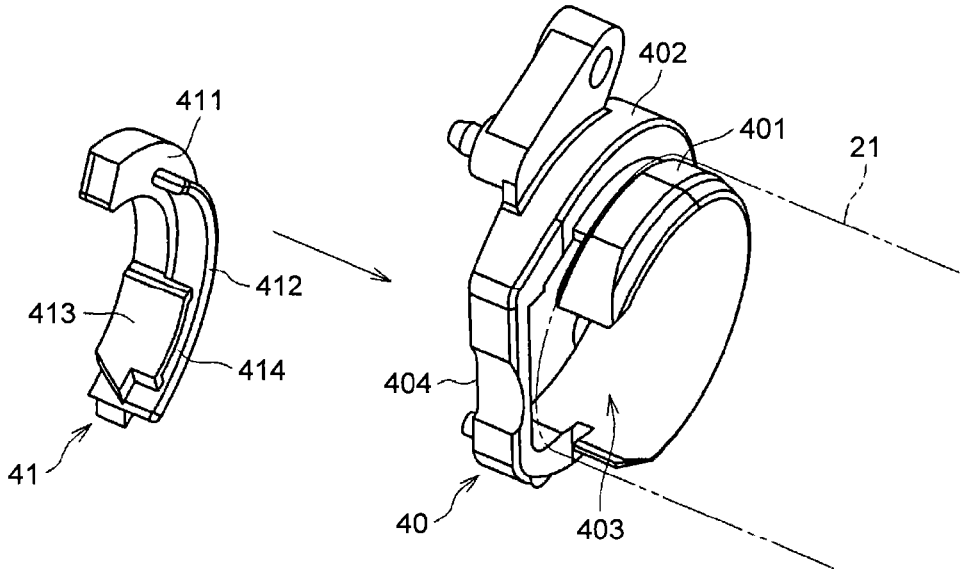
FIG. 20 is a perspective view of a holding member and a sliding member.

As illustrated in FIG. 20, the flange member 40 is in a hollow shape in which both sides in the axial direction are opened, integrally including a receiving portion 401 extending in the axial direction and a collar portion 402 protruding from the receiving portion 401 in the radial direction. The receiving portion 401 is formed in a partially cylindrical form having a notch 403 in a part of a region in the circumferential direction. As illustrated in FIG. 19, a nip forming member 24 is inserted into a space formed of the notch 403. The end portion of the nip forming member 24 is fixed to the side plate 29 through the inner circumference of the collar portion 402. Not illustrated in FIG. 19, the end portions of halogen heaters 23 and a stay 25 disposed on the inside of the fixing belt are fixed to the side plate 29 through the inner circumference of the receiving portion 401 and the inner circumference of the collar portion 402.

As illustrated in FIG. 20, the sliding member 41 is disposed as opposite to the flange member 40 in the axial direction in the region on the opposite side of the mounting side of the fixing belt 21 in the axial direction. In the following description, an opposing face 404 of the flange member 40, which faces the sliding member 41 in the axial direction, is referred to as an outer face of the flange member 40, and an opposing face 411 of the sliding member 41, which faces the flange member 40 in the axial direction, is referred to as an inner face of the sliding member 41. The sliding member 41 has an arc-shaped form when seen from the flange member 40 side. The inner face 411 of the sliding member 41 is formed with a protruded rim 412 as a male portion extending in the circumferential direction. Moreover, a bulging portion 413 is formed on the inner circumferential surface of the sliding member 41. An arc-shaped hole 414 is formed on the inner face of the bulging portion 413. The hole 414 extends in the circumferential direction of the shielding member 27. A projection 27*a* provided on the end portion of the shielding member 27 is inserted into the hole 414 (see FIG. 22). Thus, the shielding member 27 and the sliding member 41 are connected to each other, and are integrally rotatable.

Figure 21:
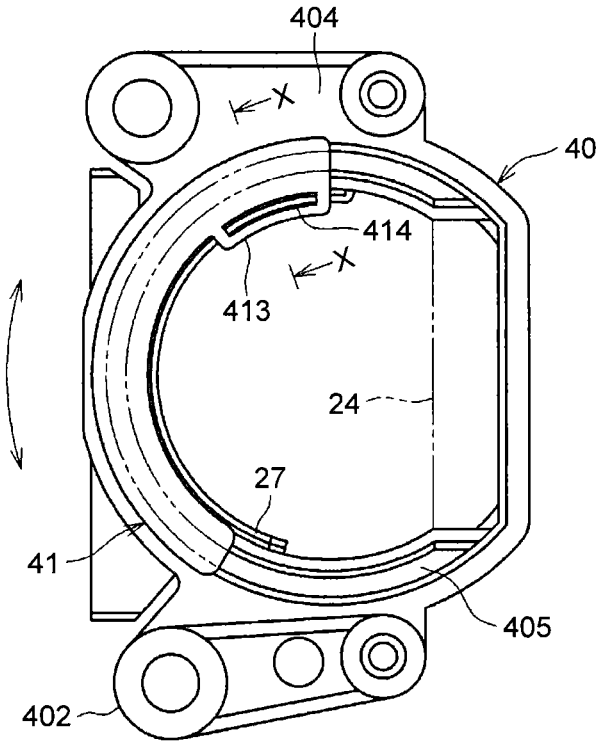
FIG. 21 is a front view of the state in which the sliding member is laid on the holding member.

The flange member 40 and the sliding member 41 are mounted on the fixing device 20 as closely contacted with each other in the axial direction. FIG. 21 is a front view of the holding member 400 and the sliding member 41 in the mounted state.

As illustrated in FIG. 21, a guide groove 405 is formed on the outer face 404 of the flange member 40. The guide groove 405 extends as a female portion in the circumferential direction. The protruded rim 412 of the sliding member 41 is fit into the guide groove 405. The length of the guide groove 405 in the circumferential direction is longer than the length of the protruded rim 412 in the circumferential direction. In the flange member 40, the region in which the guide groove 405 is almost matched with, in the axial direction, the region in which the receiving portion 401 is formed.

Both of the flange member 40 and the sliding member 41 as described above can be formed by resin injection molding. In the forming, the flange member 40 and the sliding member can be formed of a resin material of high heat resistance and high slidability such as a liquid crystal polymer and polyimide, for example. The flange member 40 and the sliding member 41 may be formed of the same kind of resin, or may be formed of different kinds of resins. In consideration of processing costs, desirably, both of the flange member 40 and the sliding member 41 are resin injection molding products. However, if the cost is not a problem, one of or both of the flange member 40 and the sliding member 41 may be formed of a metal.

Figure 22:
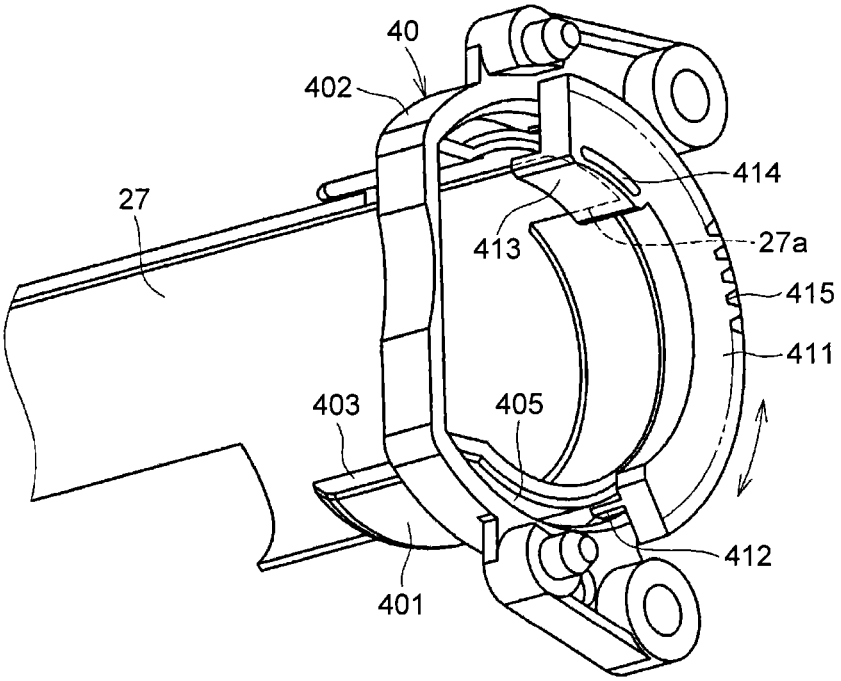
FIG. 22 is a perspective view of a support structure for the shielding member.

In FIGS. 19 to 21, in the support structure for two ends of the shielding member 27 in the axial direction, illustrated are the support structure for the end portion on the non-drive side, at which the driving mechanism 60 is not disposed, and the flange member 40 and the sliding member 41 constituting the support structure. On the contrary, as illustrated in FIG. 17 and FIG. 22, a support structure for the end portion on a drive side on which the driving mechanism 60 is disposed also basically has a configuration common in the support structure on the non-drive side. It is noted that in the support structure for the end portion on the drive side, the gear portion 415 that engages the gear 64 of the driving mechanism 60 is provided on the outer circumferential surface of the sliding member 41. On this point, the configuration is different from the sliding member 41 in the support structure for the end portion on the non-drive side without such a gear portion.

Figure 23:
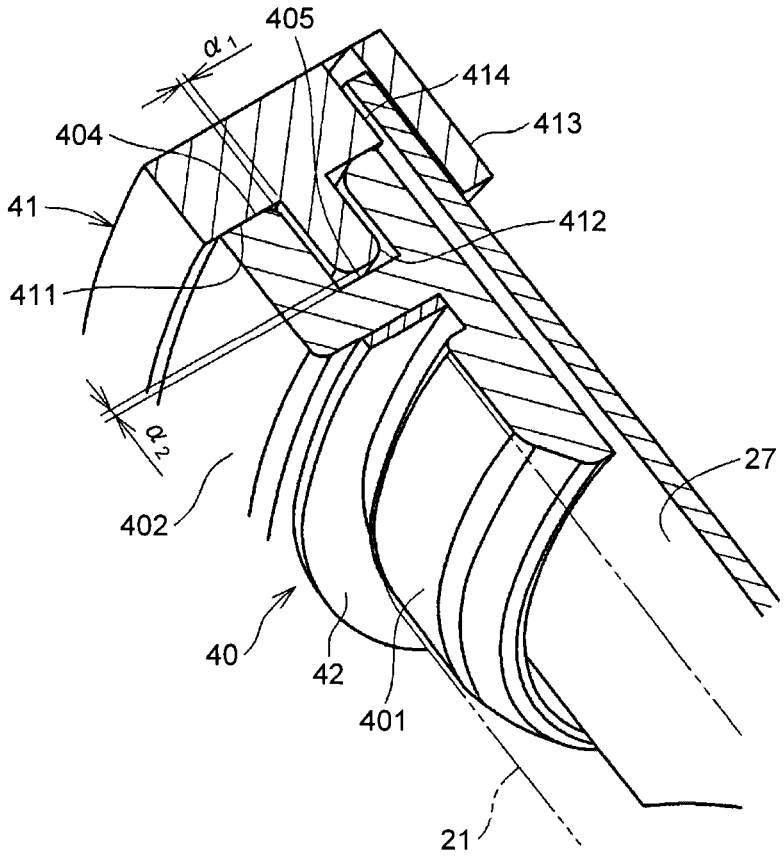
FIG. 23 is a cross sectional view along a line X-X in FIG. 21.

FIG. 23 is a cross sectional view along a line X-X in FIG. 21.

As illustrated in FIG. 23, when the protruded rim 412 of the sliding member 41 is fit into the guide groove 405 of the flange member 40, the shielding member 27 connected to the sliding member 41 is supported by the flange member 40. At this time, the protruded rim 412 is slidable in the circumferential direction in the region other than the shaft with respect to the guide groove 405. Therefore, when the sliding member 41 is rotated using the driving mechanism 60, the sliding member 41 is guided in the circumferential direction by sliding the protruded rim 412 and the guide groove 405, and the sliding member 41 is rotated about the defined position as the rotation center. Thus, the shielding member 27 is moved between the shielding position and the retraction position, and the quantity of heat applied from the halogen heaters 23 to the fixing belt 21 can be controlled. As described above, the flange member 40 according to the embodiment has a function of rotatably supporting the fixing belt 21 as well as the shielding member 27.

Figure 24:
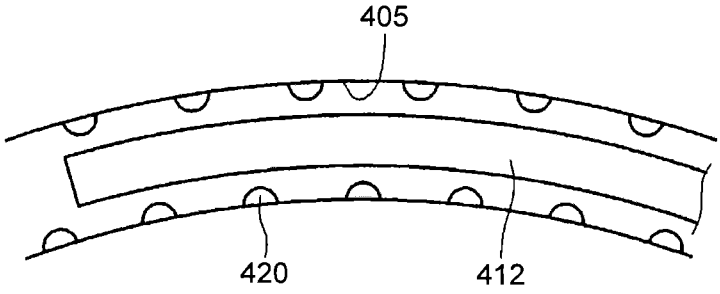
FIG. 24 is an enlarged cross sectional view of a fitting portion of a protruded rim to a guide groove.

Meanwhile, the shielding member 27 according to the embodiment is entirely formed with a thin-walled material and is formed in a partially cylindrical form. In addition, it is difficult for the shielding member 27 to secure rigidity because the shielding member 27 has a portion liable to break in an extremely narrow width (the coupling portion 49 (see FIG. 7)). Therefore, when the sliding resistance between the guide groove 405 and the protruded rim 412 is large, it is likely to cause torsion in the shielding member 27, and it is likely to vary the right and left shielding areas. Preferably, in order to prevent such a problem, gaps ($\alpha$1 and $\alpha$2) in appropriate sizes are provided in the radial direction and in the axial direction of the shielding member 27 between the guide groove 405 and the protruded rim 412 as illustrated in FIG. 23 for reducing the sliding resistance. The gaps $\alpha$1 and $\alpha$2 also serve to suppress an increase in the sliding resistance between the guide groove 405 and the protruded rim 412 when thermal expansion occurs at a high temperature. In order to reduce the sliding resistance between the guide groove 405 and the protruded rim 412, a plurality of micro projections 420 may be formed on the opposing inner faces of the guide groove 405 as illustrated in FIG. 24. The micro projections 420 may be formed on the circumferential face of the protruded rim 412 in addition to providing the micro projections 420 on the inner faces of the guide groove 405.

The support structure for the shielding member 27 described above has the following features.

The spaces on both sides of the fixing belt 21 in the axial direction only need to have a thickness enough to accommodate therein the flange member 40 and the sliding member 41 closely contacted with each other in the axial direction. Therefore, the support structure for the shielding member 27 can be made compact, and the flexibility of the layout near the fixing device 20 can be improved.

In a case where a nearly cylindrical member like the shielding member 27 is rotatably supported, it is a typical configuration in which a shaft is disposed in the rotation center of the member and the shaft is supported by a shaft bearing. However, in a case where such a configuration is adopted, the spaces in the axial direction are increased. Moreover, it is necessary to provide a member to connect the shaft to the shielding member 27, and the heat capacity of the entire shielding member 27 is increased to mount energy loss. Furthermore, it is difficult to prepare the shielding member 27 only by plastic-working a metal plate when a connecting member is integrally formed with the shielding member 27, whereas the number of parts is increased when the connecting member is formed as a separate member. Therefore, costs are increased in any cases.

On the contrary, in the embodiment, the opposing faces 404 and 411 are provided on the sliding member 41, which is a rotation-side member, and the flange member 40, which is a stationary-side member, respectively. The opposing faces 404 and 411 are opposite to each other in the axial direction. The guide groove 405 (the female portion) is formed on the opposing face 404 (the outer face) of the flange member 40, and the protruded rim 412 (the male portion) is provided on the opposing face 411 (the inner face) of the sliding member 41. The protruded rim 412 can be fit into the guide groove 405. The guide groove 405 and the protruded rim 412 are slidable in the circumferential direction of the shielding member 27. With this configuration, the protruded rim 412 is fit into the guide groove 405 to support the load of the shielding member 27 by the flange member 40, and the guide groove 405 and the protruded rim 412 are slid to guide the rotation direction of the shielding member 27. Therefore, the shielding member 27 can be rotatably supported in a compact configuration. In this case, it is unnecessary to dispose a shaft in the rotation center of the shielding member 27, and it is unnecessary to connect the shaft to the shielding member 27. Therefore, the forgoing problem can be eliminated.

Even though a pin as a male portion is fit into the guide groove 405, the shielding member 27 can be similarly rotatably supported. However, in such a configuration, since the guide groove and the pin are in point contact or in line contact with each other, the attitude of the shielding member 27 is unstable, and it is difficult to highly accurately control the quantity of heat applied to the fixing belt 21. On the contrary, in the embodiment, the protruded rim 412 having some length in the circumferential direction is fit into the guide groove 405, and the protruded rim 412 and the guide groove 405 are in surface contact, so that the attitude of the shielding member 27 can be stabilized.

When the driving mechanism 60 is disposed on one end of the shielding member 27 in the axial direction for rotating the fixing belt 21, the configuration of the fixing device 20 can be simplified as compared with the case where the driving mechanism 60 is disposed at both ends. Therefore, the flexibility of the layout can be further improved.

As illustrated in FIG. 23, in the region to be the mounting side of the fixing belt 21 between both sides of the flange member 40 in the axial direction, a slip ring 42 is disposed between the end portion of the fixing belt 21 in the axial direction and the collar portion 402 of the flange member 40 for preventing direct contact between the end portion of the fixing belt 21 and the collar portion 402. Because the slip ring is provided as described above, it is difficult to fit the protruded rim 412 into the guide groove 405 even in a case where the guide groove 405 is formed on one of the rotation side and the stationary side in the region to be the mounting side of the fixing belt 21 in the flange member 40 and the protruded rim 412 is formed on the other side. On the contrary, in the embodiment, the sliding member 41 is connected to the shielding member 27, the sliding member 41 is disposed opposite to the flange member 40 in the region on the opposite side of the fixing belt 21 in the axial direction, and the guide groove 405 and the protruded rim 412 are disposed on the opposing region. Therefore, the protruded rim 412 can be reliably fit into the guide groove 405 regardless of the slip ring 42.

Both of the flange member 40 and the sliding member 41 are formed of a resin, so that the sliding resistance between the guide groove 405 and the protruded rim 412 can be further reduced, and the torsion of the shielding member 27 can be reliably prevented.

As illustrated in FIG. 3, in a case where the shielding member 27 is rotated in the direction in which the shielding area is reduced (particularly in the case where the shielding member 27 is moved at the retraction position), one end portion of the shielding member 27 comes close to the nip forming member 24 disposed in the inside of the fixing belt.

Here, for example, in a case where the connecting portion (the hole 414) between the sliding member 41 and the shielding member 27 is provided near the middle part of the sliding member 41 in the circumferential direction, the sliding member 41 interferes with the nip forming member 24 to restrict the rotation to go even though the shielding member 27 is rotated in the retraction direction. Therefore, it is likely that the retraction of the shielding member 27 is insufficient. On the contrary, as illustrated in FIG. 21, when the connecting portion at which to the sliding member 41 and the shielding member 27 are connected is disposed at the end portion of the sliding member 41 coming close to the nip forming member 24 in rotating the shielding member 27 in the retraction direction in which the shielding area is decreased in the sliding member 41, the moving stroke of the shielding member 27 can be increased at the maximum, and the shielding member 27 can be reliably moved to the retraction position.

In the embodiments, an example is taken and described in which the present invention is applied to the fixing device using the fixing belt. However, the present invention may be also applicable to a configuration using a hollow (tubular) fixing roller or a solid fixing roller instead of the fixing belt. Moreover, the shape of the shielding member is not limited to the shapes in the foregoing embodiments. The shielding member may be formed in a shape in which three or more of steps are provided according to paper sizes. Furthermore, the image forming apparatus including the fixing device according to the present invention is not limited to the printer as illustrated in FIG. 1. The image forming apparatus may be a copying machine, a facsimile, or an MFP of them, for example.

In addition, in the embodiment, the case is exemplified where the protruded rim 412 as a male portion is formed on the sliding member 41 on the movable side and the guide groove 405 as a female portion is formed on the flange member 40 on the fixed side. However, on the contrary, such a configuration may be possible in which the guide groove as a female portion is formed on the sliding member 41 on the movable side and the protruded rim 412 as a male portion is formed on the flange member 40 on the fixed side. Moreover, such a configuration may be possible in which the sliding member 41 is omitted, the protruded rim 412 is formed on one end portion of the shielding member 27 to be a rotation-side member, and the protruded rim 412 is directly fit into the guide groove 405 provided on the outer face 404 of the flange member 40.

The foregoing description is an example, and the third embodiment includes the following aspects (1) to (9).

(1) A fixing device includes a fixing member that is rotatably supported; a heating source configured to heat the fixing member; an opposing member configured to come into contact with an outer circumferential surface of the fixing member to form a nip portion; a shielding member configured to block heat from the heating source toward the fixing member and configured to rotate to thereby increase or decrease a shielding area thereof; and a supporting unit configured to rotatably support the shielding member. The supporting unit includes a rotation-side member to be connected to the shielding member and a stationary-side member, the rotation-side member and the stationary-side member include opposing faces opposite to each other in an axial direction, a female portion is formed on one of the two opposing faces and a male portion that is enabled to be fit into the female portion is provided on the other of the two opposing faces, and the male portion and the female portion are configured to be slidable in a circumferential direction of the shielding member.

(2) In the fixing device according to aspect (1), the female portion is a guide groove extending in a circumferential direction of the shielding member, and the male portion is a protruded rim extending in the circumferential direction of the shielding member.

(3) In the fixing device according to aspect (1) or (2), the supporting unit is disposed at two ends of the shielding member in an axial direction, and a driving mechanism configured to rotate the shielding member is disposed on one end of the shielding member in the axial direction.

(4) In the fixing device according to any one of aspects (1) to (3), the shielding member is entirely formed in a partial cylindrical face shape with a thin plate member.

(5) In the fixing device according to any one of aspects (1) to (4), the fixing member is an endless fixing belt that includes the heating source and the shielding member disposed on an inner circumferential side of the endless fixing belt, and the stationary-side member is a belt holding member that is fit into two ends of the fixing belt in an axial direction to rotatably support the fixing belt.

(6) In the fixing device according to aspect (5), the rotation-side member is a sliding member to be connected to the shielding member, the belt holding member and the sliding member includes the opposing faces, and the sliding member is disposed opposite to the belt holding member in a region on an opposite side of the fixing belt in the axial direction.

(7) In the fixing device according to aspect (6), both of the holding member and the sliding member are formed of a resin.

(8) In the fixing device according to claim (6) or (7), the fixing device further includes a nip forming member configured to come into contact with the opposing member from an inner circumferential side of the fixing belt to form the nip portion. A connecting portion at which the sliding member and the shielding member are connected is disposed at an end portion of the sliding member, the end portion coming close to the nip forming member when the shielding member is rotated in a direction in which the shielding area is decreased.

(9) An image forming apparatus including the fixing device accruing to any one of aspects (1) to (8).

According to the third embodiment, the male portion is fit into the female portion to support the load of the shielding member by the stationary-side member, and the male portion and the female portion are slid in the circumferential direction to guide the shielding member in the rotation direction. Therefore, a simple, compact configuration can rotatably support the shielding member, the flexibility of the layout of the fixing device as well as the image forming apparatus can be improved, and costs of the fixing device and the image forming apparatus can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device, comprising:

a rotatable fixing member;

a heating source configured to heat the fixing member, the heating source including a radiant heater;

an opposing member configured to come into contact with an outer circumferential surface of the fixing member to form a nip portion; and a shielding member configured to block heat from the heating source, wherein the shielding member is configured to rotate about a position different from the center of the heating source so as to be movable between a shielding position and a retraction position, the shielding position being a position where the shielding member comes close to the heating source to block heat from the heating source to the fixing member, the retraction position being a position where the shielding member is retracted away from the shielding position, wherein:

the fixing member is an endless fixing belt, and the fixing device further includes a nip forming member configured to come into contact with the opposing member from an inner circumferential side of the fixing belt to form the nip portion.

2. The fixing device according to claim 1, wherein the heating source is disposed on an inner circumferential side of the fixing belt and on an upstream side of the nip portion in a recording medium transfer direction, and more of the shielding member is arranged on the upstream side of the nip portion in the recording medium transfer direction at the shielding position as compared to when the shielding member is in a retracted position.

3. The fixing device according to claim 1, wherein the shielding member is configured such that, when the shielding member is rotated and moved from the shielding position to the retraction position, a nearby region of the shielding member close to the heating source is reduced and a distant region of the shielding member far from the heating source is increased.

4. An image forming apparatus comprising the fixing device according to claim 1.

5. The fixing device according to claim 1, wherein:

the fixing device further includes a support member configured to support the nip forming member, and when the shielding member is rotated and moved from the shielding position to the retraction position, at least a part of the shielding member is moved to an opposite side of the support member with respect to the heating source.

6. The fixing device according to claim 1, further comprising a reflecting member to reflect heat from the heating source to the fixing member, wherein when the shielding member is rotated and moved from the shielding position to the retraction position, at least a part of the shielding member is moved on an opposite side of the reflecting member with respect to the heating source.

7. A fixing device, comprising:

a rotatable fixing member;

a heating source configured to heat the fixing member, the heating source including a radiant heater;

an opposing member configured to come into contact with an outer circumferential surface of the fixing member to form a nip portion; and a shielding member configured to block heat from the heating source, wherein the shielding member is configured to rotate about a position different from the center of the heating source so as to be movable between a shielding position and a retraction position, the shielding position being a position where the shielding member comes close to the heating source to block heat from the heating source to the fixing member, the retraction position being a position where the shielding member is retracted away from the shielding position, wherein:

the fixing device includes a direct heating region in which the heating source directly heats the fixing member as facing the fixing member and an indirect heating region in which another member other than the shielding member is provided between the heating source and the fixing member, and the shielding member is disposed on the direct heating region side at the shielding position, and the shielding member is disposed on the indirect heating region side at the retraction position.

8. An image forming apparatus comprising the fixing device according to claim 7.

9. The fixing device according to claim 7, wherein the fixing member is an endless fixing belt, the fixing device further includes a nip forming member to come into contact with the opposing member from an inner circumferential side of the fixing belt to form the nip portion; and a support member to support the nip forming member, and when the shielding member is rotated and moved from the shielding position to the retraction position, at least a part of the shielding member is moved to an opposite side of the support member with respect to the heating source.

10. The fixing device according to claim 7, further comprising a reflecting member to reflect heat from the heating source to the fixing member, wherein when the shielding member is rotated and moved from the shielding position to the retraction position, at least a part of the shielding member is moved on an opposite side of the reflecting member with respect to the heating source.

11. A fixing device, comprising:

a rotatable fixing member;

a plurality of heating sources configured to heat the fixing member, the heating sources including radiant heaters;

an opposing member configured to come into contact with an outer circumferential surface of the fixing member to form a nip portion; and a shielding member configured to block heat from the heating sources, wherein the shielding member is configured to rotate about a position different from the center of the heating sources so as to be movable between a shielding position and a retraction position, the shielding position being a position where the shielding member comes close to the heating sources to block heat from the heating sources to the fixing member, the retraction position being a position where the shielding member is retracted away from the shielding position, wherein:

the rotation center of the shielding member is disposed at a position different from the centers of the plurality of the heating sources.

12. The fixing device according to claim 11, wherein the fixing member is an endless fixing belt, the fixing device further includes a nip forming member configured to come into contact with the opposing member from an inner circumferential side of the fixing belt to form the nip portion; and a support member configured to support the nip forming member, and when the shielding member is rotated and moved from the shielding position to the retraction position, at least a part of the shielding member is moved to an opposite side of the support member with respect to the heating source.

13. The fixing device according to claim 11, further comprising a reflecting member configured to reflect heat from the heating source to the fixing member, wherein when the shielding member is rotated and moved from the shielding position to the retraction position, at least a part of the shielding member is moved on an opposite side of the reflecting member with respect to the heating source.

14. An image forming apparatus comprising the fixing device according to claim 11.

15. A fixing device, comprising:

a rotatable fixing member;

a heating source configured to heat the fixing member, the heating source including a radiant heater;

an opposing member configured to come into contact with an outer circumferential surface of the fixing member to form a nip portion; and a shielding member configured to block heat from the heating source, wherein the shielding member is configured to rotate about a position different from the center of the heating source so as to be movable between a shielding position and a retraction position, the shielding position being a position where the shielding member comes close to the heating source to block heat from the heating source to the fixing member, the retraction position being a position where the shielding member is retracted away from the shielding position, wherein:

the shielding member is configured to be movable between an initial position set in advance and a position different from the initial position according to a width size of a recording medium passing through the nip portion, and the fixing device further includes an initial position detecting unit configured to detect an initial position of the shielding member.

16. The fixing device according to claim 15, wherein the fixing member is an endless fixing belt, and the fixing device further includes a nip forming member configured to come into contact with the opposing member from an inner circumferential side of the fixing belt to form the nip portion.

17. The fixing device according to claim 15, wherein the initial position detecting unit includes a to-be-detected member configured to operate together with the shielding member and a detection sensor configured to detect a position of the to-be-detected member.

18. The fixing device according to claim 17, wherein the to-be-detected member is connected to the shielding member through a link member.

19. An image forming apparatus comprising the fixing device according to claim 15.

20. A fixing device, comprising:

a rotatable fixing member;

a heating source configured to heat the fixing member, the heating source including a radiant heater;

an opposing member configured to come into contact with an outer circumferential surface of the fixing member to form a nip portion; and a shielding member configured to block heat from the heating source, wherein the shielding member is configured to rotate about a position different from the center of the heating source so as to be movable between a shielding position and a retraction position, the shielding position being a position where the shielding member comes close to the heating source to block heat from the heating source to the fixing member, the retraction position being a position where the shielding member is retracted away from the shielding position, the fixing device further comprising:

a supporting unit that includes a rotation-side member to be connected to the shielding member and a stationary-side member and is configured to rotatably support the shielding member, wherein the rotation-side member and the stationary-side member include opposing faces opposite to each other in an axial direction, a female portion is formed on one of the two opposing faces and a male portion that is enabled to be fit into the female portion is provided on the other of the two opposing faces, and the male portion and the female portion are configured to be slidable in a circumferential direction of the shielding member.

21. The fixing device according to claim 20, wherein the female portion is a guide groove extending in a circumferential direction of the shielding member, and the male portion is a protruded rim extending in the circumferential direction of the shielding member.

22. The fixing device according to claim 20, wherein the supporting unit is disposed at two ends of the shielding member in an axial direction, and a driving mechanism configured to rotate the shielding member is disposed on one end of the shielding member in the axial direction.

23. The fixing device according to claim 22, wherein the rotation-side member is a sliding member to be connected to the shielding member, the belt holding member and the sliding member includes the opposing faces, and the sliding member is disposed opposite to the belt holding member in a region on an opposite side of the fixing belt in the axial direction.

24. The fixing device according to claim 20, wherein the fixing member is an endless fixing belt that includes the heating source and the shielding member disposed on an inner circumferential side of the endless fixing belt, and the stationary-side member is a belt holding member that is fit into two ends of the fixing belt in an axial direction to rotatably support the fixing belt.

25. The fixing device according to claim 24, further comprising a nip forming member configured to come into contact with the opposing member from an inner circumferential side of the fixing belt to form the nip portion, wherein the shielding member is configured to rotate to thereby increase or decrease a shielding area thereof, a connecting portion at which the sliding member and the shielding member are connected is disposed at an end portion of the sliding member, the end portion coming close to the nip forming member when the shielding member is rotated in a direction in which the shielding area is decreased.

26. An image forming apparatus comprising the fixing device according to claim 20.

27. A fixing device comprising:

a rotatable fixing member;

a heater to heat the fixing member;

an opposing member to come into contact with an outer circumferential surface of the fixing member to form a nip portion; and a shielding member to block heat from the heating source, wherein:

the shielding member is to rotate about a position different from the center of the heating source so as to be movable between a shielding position and a retraction position, the shielding position being a position where the shielding member comes close to the heating source to block heat from the heating source to the fixing member, the retraction position being a position where the shielding member is retracted away from the shielding position, the shielding member is movable between an initial position set in advance and a position different from the initial position according to a width size of a recording medium passing through the nip portion, and the fixing device further includes an initial position detector to detect an initial position of the shielding member.

28. The fixing device according to claim 27, wherein the fixing member includes an endless fixing belt, and the fixing device further includes a nip forming member to come into contact with the opposing member from an inner circumferential side of the fixing belt to form the nip portion.

29. The fixing device according to claim 27, wherein the initial position detector includes a to-be-detected member to operate together with the shielding member and a detection sensor to detect a position of the to-be-detected member.

30. The fixing device according to claim 29, wherein the to-be-detected member is connected to the shielding member through a link member.

31. An image forming apparatus comprising the fixing device according to claim 27.

* * * * *